US005829291A

United States Patent [19]

Tanaka et al.

[11] Patent Number: 5,829,291

[45] Date of Patent: Nov. 3, 1998

[54] APPARATUS AND PROCESS FOR FORMING METAL MEMBER INCLUDING BASES PORTION AND CYLINDRICAL PORTION FORMED ON OUTER SURFACE OF THE BASE PORTION SUCH THAT THE CYLINDRICAL PORTION IS INTEGRAL WITH THE BASE PORTION

[75] Inventors: Hideaki Tanaka, Okazaki; Tadayuki Asano, Toyota; Masanori Ogawa, Aichi-ken, all of Japan

[73] Assignee: Kojima Press Industry Co., Ltd., Japan

[21] Appl. No.: 857,339

[22] Filed: May 16, 1997

[30] Foreign Application Priority Data

May 17, 1996 [JP] Japan ..... 8-122093
Nov. 7, 1996 [JP] Japan ..... 8-295011

[51] Int. Cl.[6] ..... B21H 1/06

[52] U.S. Cl. ..... 72/71; 72/110

[58] Field of Search ..... 72/71, 110; 29/894.324, 29/894.362

[56] References Cited

U.S. PATENT DOCUMENTS

| | | | |
|---|---|---|---|
| 2,379,584 | 7/1945 | Litton | 72/71 |
| 4,884,427 | 12/1989 | Sawahata et al. | 72/111 |
| 4,953,275 | 9/1990 | Mori . | |
| 5,195,241 | 3/1993 | Bradfield . | |
| 5,236,115 | 8/1993 | Pape | 72/71 |

FOREIGN PATENT DOCUMENTS

| | | | |
|---|---|---|---|
| 3410308 | 10/1985 | Germany | 29/894.324 |
| 3-13242 | 1/1991 | Japan | 72/71 |
| 5-185175 | 7/1993 | Japan . | |

*Primary Examiner*—Lowell A. Larson
*Attorney, Agent, or Firm*—Parkhurst & Wendel

[57] ABSTRACT

An apparatus for forming a metal blank into a formed body, including a die device including a first and a second die each of which is rotatable about a first axis line, a first roller which is rotatable about a second axis line parallel to the first axis line and which is movable toward, and away from, the die device, the first roller having a tapered outer surface which defines at one end thereof a taper angle of from 60° to 80°, the tapered outer surface of the first roller being pressed against an original disklike base portion of the metal blank being rotated with the first and second dies about the first axis line, so that that one end of the tapered outer surface peels a portion of the original disklike base portion and an entirety of the tapered outer surface deforms the peeled portion into a tapered portion, and a second roller which is rotatable about a third axis line parallel to the first axis line and which is movable toward, and away from, the die device, the second roller having a cylindrical outer surface and being pressed against the tapered portion of the metal blank being rotated with the first and second dies about the first axis line, so that the second roller cooperates with the first die to sandwich the tapered portion and deforms the tapered portion into a cylindrical portion of the formed body.

13 Claims, 20 Drawing Sheets

APPARATUS AND PROCESS FOR FORMING METAL MEMBER INCLUDING BASES PORTION AND CYLINDRICAL PORTION FORMED ON OUTER SURFACE OF THE BASE PORTION SUCH THAT THE CYLINDRICAL PORTION IS INTEGRAL WITH THE BASE PORTION

BACKGROUND OF THE INVENTION

1. Field of the Invention

The present invention relates to an apparatus and a process for forming a metal blank into a metal member including a base portion and a cylindrical portion formed on an outer surface of the base portion such that the cylindrical portion is integral with the base portion.

2. Related Art Statement

There have been known various techniques each for forming a metal blank into a formed body, such as a viscous-coupling housing or a one-piece wheel for an automotive vehicle, which includes a disklike base portion and a cylindrical portion formed on an outer surface of the base portion such that the cylindrical portion is integral, and concentric, with the base portion. According to one of those techniques, a metal blank is formed into a formed body by the combination of cutting and rolling.

Japanese Patent Application laid open for inspection under Publication No. 5-185175 discloses a cutting and rolling technique for forming a one-piece wheel. The drawings of the Japanese document show the technique of forming a generally disklike metal blank into a one-piece wheel including a disk portion and cylindrical inner and outer rims which are formed on opposite outer surfaces of the disk portion, respectively, such that the two rims are integral, and concentric, with the disk portion and project in opposite directions from the disk portion. First, the disklike metal blank to be formed into the aimed one-piece wheel is concentrically sandwiched between two dies at least one of which is movable toward, and away from, the other along a common axis line. Then, while the two dies are rotated with each other, a cutting roller is pressed against an original base portion (i.e., rim portion) of the metal blank, so that the angled tip portion of the cutting roller cuts into the rim portion over a predetermined radial length or depth. Thus, the rim portion is separated into two rim portions. Subsequently, a rolling roller is pressed against one of the rim portions, and is moved in a direction of thickness of the metal blank away from the disk portion. Thus, the one rim portion is sandwiched between the rolling roller and the corresponding die, and is subject to ironing. Thus, the rim portion is bent and elongated in the direction of moving of the rolling roller, and is formed into the cylindrical outer rim. Similarly, the rolling roller is pressed against the other rim portion, and is moved in the opposite direction away from the disk portion. Thus, the rim portion is sandwiched between the rolling roller and the corresponding die, and is subject to ironing. Thus, the rim portion is bent and elongated in the direction of moving of the rolling roller, and is formed into the cylindrical inner rim.

In the above forming process in which cutting and rolling are combined, cutting is following by rolling in which each half rim portion is repeatedly subjected to local deformation in a circumferential direction thereof resulting from the rolling contact of the rolling roller and is thereby formed into the corresponding cylindrical rim. Accordingly, the metal blank is formed into the aimed formed body with a considerably small working force. However, since the formation of each half rim portion into the corresponding cylindrical rim is carried out by ironing the entirety of the rim portion using the rolling roller, the formed cylindrical rim suffers from high work hardening.

If a metal blank having a high hardness (e.g., Vickers hardness: 160), such as medium carbon steel (S45C), is formed into a formed body by the above-described forming process, the formed cylindrical rim suffers from a higher than 200 Vickers hardness because of the work hardening resulting from the rolling of the rolling roller. In this case, the cylindrical rim becomes brittle and may suffer from "cracks".

For the above reasons, in the case where a metal blank having a high hardness is formed into a formed body, it has been common to combine forging that needs a high cost and cutting that needs a lot of labor and a long time.

SUMMARY OF THE INVENTION

It is therefore a first object of the present invention to provide an apparatus which forms, with high efficiency and with high quality, a metal blank into a formed body including a base portion and a cylindrical portion formed on an outer surface of the base portion such that the cylindrical portion is integral with the base portion, irrespective of the properties of the metal blank.

It is a second object of the present invention to provide a process of forming, with high efficiency and with high quality, a metal blank into a formed body including a base portion and a cylindrical portion formed on an outer surface of the base portion such that the cylindrical portion is integral with the base portion, irrespective of the properties of the metal blank.

The above first object has been achieved according to a first aspect of the present invention, which provides an apparatus for forming a metal blank into a formed body including a disklike base portion and a cylindrical portion formed on an outer surface of the base portion such that the cylindrical portion is integral, and concentric, with the base portion, comprising a die device comprising a first die and a second die each of which is rotatable about a first axis line, the first die having a cylindrical outer surface corresponding to a cylindrical inner surface of the cylindrical portion of the formed body, at least one of the first and second dies being movable toward, and away from, the other of the first and second dies along the first axis line, the first and second dies being rotatable with each other about the first axis line while sandwiching the metal blank comprising an original disklike base portion having a diameter greater than a diameter of the first die, such that the original disklike base portion is concentric with the first and second dies with respect to the first axis line; a first roller which is rotatable about a second axis line parallel to the first axis line and which is movable toward, and away from, the die device in a first direction perpendicular to the first axis line, the first roller having a tapered outer circumferential surface whose diameter decreases in a second direction from one of axially opposite ends thereof on a side of the second die toward the other end thereof on a side of the first die and which defines, at the one end thereof, a first taper angle of from 60° to 80° with respect to a plane perpendicular to the second axis line, the tapered outer surface of the first roller being pressed against the original disklike base portion of the metal blank being rotated with the first and second dies about the first axis line, so that the one end of the tapered outer surface peels a portion of the original disklike base portion and an entirety of the tapered outer surface deforms the peeled portion into a tapered portion having a tapered outer circumferential surface corresponding to the tapered outer surface of the first roller; and a second roller which is rotatable about a third axis line parallel to the first axis line and which is movable toward, and away from, the die device in a third direction perpendicular to the first axis line, the second roller having a cylindrical outer surface extending in a fourth direction parallel to the third axis line, the cylindrical outer surface of the second roller being pressed against the tapered portion of the metal blank being rotated with the first and second dies about the first axis line, so that the second roller cooperates with the first die to sandwich the tapered portion and deforms the tapered portion into the cylindrical portion of the formed body which has a cylindrical outer surface corresponding to the cylindrical outer surface of the second roller.

In the forming apparatus constructed as described above, the first and second dies are rotated together with each other about the first axis line while sandwiching the metal blank to be formed into the aimed formed body, and the first roller having the tapered outer surface whose diameter decreases in the second direction and which defines the first taper angle is moved toward the die device in the first direction so that the tapered outer surface is pressed against the original base portion of the metal blank, peels a portion of the original base portion, and gradually deforms or raises the peeled portion into the tapered portion having the tapered outer surface which corresponds to the tapered outer surface of the first roller but whose diameter increases in the second direction.

In addition, the second roller which has the cylindrical outer surface extending in the fourth direction is moved toward the die device in the third direction, so that the cylindrical outer surface is pressed against the tapered portion of the metal blank, bends the tapered portion at its base or root inward, i.e., toward the first axis line, and cooperates with the first die to sandwich the bent portion and deform it into the cylindrical portion of the formed body. Thus, the metal blank is formed into the formed body which includes the cylindrical portion corresponding to the peeled portion, and the disklike base portion corresponding to the remaining portion of the original disklike base portion, such that the cylindrical portion is integral, and concentric, with the base portion.

In short, in the forming apparatus in accordance with the first aspect of the invention, the first roller which functions as a peeling and rolling roller is just pressed against the outer surface of the original base portion of the metal blank and moved in the first direction, whereby peeling is effected to peel a portion of the original base portion from the remaining portion of the same and rolling is effected to roll the peeled portion into a tapered portion having a certain taper angle. Subsequently, the second roller which functions as a rolling roller is just pressed against the tapered portion of the metal blank and is moved in the third direction perpendicular to the first axis line, whereby rolling is effected to bend the tapered at its base or root toward the first axis line and deform the entirety of the tapered portion into the cylindrical portion of the formed body.

Therefore, the present forming apparatus does not need, for the purpose of rolling a peeled portion of a metal blank into a tapered portion, ironing that has conventionally been effected by moving a rolling roller in the axial direction thereof while pressing the roller against the peeled portion of the metal blank in a direction perpendicular to the axis line of the metal blank. Accordingly, the first roller of the present apparatus is pressed against the entirety of the peeled portion of the metal blank with a considerably small force (i.e., working force). In addition, when the second roller is pressed against the tapered portion of the metal blank for deforming it into the cylindrical portion, it is bent at its base or root. Thus, only that very portion is subjected to work hardening. Thus, the present apparatus effectively prevents the peeled portion of the metal blank from being pressed with a great force and being entirely subjected to work hardening. Even in the case where a metal blank having a high hardness, such as medium carbon steel, is formed into a formed body including a cylindrical portion, a peeled portion of the metal blank is prevented from being entirely hardened and accordingly the cylindrical portion deformed from the peeled portion is effectively prevented from becoming brittle.

Thus, the present forming apparatus can peel and roll a metal blank, even if it may have a high hardness, into a formed body which is free from defects such as "cracks" which may be encountered in the conventional forming apparatus. Moreover, the present apparatus which employs the first roller as the peeling and rolling roller can be operated at a lower cost and in a shorter time than the conventional apparatus which combines forging and cutting. Consequently the present apparatus can produce cylindrical products with high efficiency and with high quality, whatever properties the metal blank may have.

The cylindrical outer surface of the second roller may be provided by a portion or entirety of the outer surface of the second roller. In the former case, the second roller may have a stepped cylindrical shape including a large-diameter cylindrical portion and a small-diameter cylindrical portion. Otherwise, the second roller may include a "full" tapered portion which terminates into a point, or a "truncated" tapered portion which terminates into a circular end face, in addition to a cylindrical portion having the cylindrical outer surface.

According to a preferred feature of the first aspect of the invention, the first die has a projection on the cylindrical outer surface thereof, and wherein the second roller cooperates with the first die to sandwich the tapered portion of the metal blank and deforms the tapered portion into the cylindrical portion of the formed body which has the cylindrical inner surface including a recess corresponding to the projection. The shape and number of the projection or projections provided on the outer surface of the first die may be changed depending upon the purpose or use of the formed body. In this case, when the cylindrical portion is integrally formed with the base portion, the recess or recesses, such as a key groove or grooves, is or are simultaneously formed in the inner surface of the cylindrical portion.

According to another feature of the first aspect of the invention, the first die has a recess in the cylindrical outer surface thereof, and wherein the second roller cooperates with the first die to sandwich the tapered portion of the metal blank and deforms the tapered portion into the cylindrical portion of the formed body which has the cylindrical inner surface including a projection corresponding to the recess. The shape and number of the recess or recesses provided in the outer surface of the first die may be changed depending upon the purpose or use of the formed body. In this case, when the cylindrical portion is integrally formed with the base portion, the projection or projections, such as a spline key or keys, is or are simultaneously formed on the inner surface of the cylindrical portion.

According to another feature of the first aspect of the invention, the forming apparatus further comprises a third roller which is rotatable about a fourth axis line parallel to the first axis line and which is movable toward, and away from, the die device in a fifth direction perpendicular to the first axis line, the third roller having a tapered outer circumferential surface whose diameter decreases in a sixth direction from one of axially opposite ends thereof on a side of the second die toward the other end thereof on a side of the first die and which defines a second taper angle greater than the first taper angle with respect to a plane perpendicular to the fourth axis line, the third roller having a first annular groove in the tapered outer surface thereof, the tapered outer surface of the third roller being pressed against the tapered portion of the metal blank being rotated with the first and second dies about the first axis line, so that the third roller modifies the tapered portion into a modified tapered portion which has a modified tapered outer surface including an annular ridge corresponding to the first annular groove.

According to another feature of the first aspect of the invention, the second roller has a second annular groove in the outer cylindrical surface thereof, and cooperates with the first die to sandwich the modified tapered portion of the metal blank, force the annular ridge of the modified tapered portion into the second annular groove, and deform the modified tapered portion into the cylindrical portion of the formed body which has the cylindrical outer surface including an annular flange corresponding to the second annular groove. In this case, when the cylindrical portion is formed, the annular flange having a desired shape is simultaneously formed as an integral portion of the cylindrical portion.

The second object has been achieved according to a second aspect of the present invention, which provides a process of forming a metal blank into a formed body including a disklike base portion and a cylindrical portion formed on an outer surface of the base portion such that the cylindrical portion is integral, and concentric, with the base portion, the process comprising the steps of moving at least one of a first die and a second die of a die device, toward the other of the first and second dies, along a first axis line about which each of the first and second dies is rotatable, so that the first and second dies sandwich the metal blank comprising an original disklike base portion having a diameter greater than a diameter of the first die, such that the original disklike base portion is concentric with the first and second dies with respect to the first axis line, the first die having a cylindrical outer surface corresponding to a cylindrical inner surface of the cylindrical portion of the formed body, the one of the first and second dies being movable toward, and away from, the other of the first and second dies along the first axis line, rotating the first and second dies with each other about the first axis line while sandwiching the metal blank, moving a first roller toward the original disklike base portion of the metal blank being rotated with the first and second dies about the first axis line, the first roller being rotatable about a second axis line parallel to the first axis line, and being movable toward, and away from, the die device in a first direction perpendicular to the first axis line, the first roller having a tapered outer circumferential surface whose diameter decreases in a second direction from one of axially opposite ends thereof on a side of the second die toward the other end thereof on a side of the first die and which defines, at the one end thereof, a first taper angle of from 60° to 80° with respect to a plane perpendicular to the second axis line, pressing the tapered outer surface of the first roller against the original disklike portion of the metal blank, so that the one end of the tapered outer surface peels a portion of the original disklike base portion and an entirety of the tapered outer surface deforms the peeled portion into a tapered portion having a tapered outer circumferential surface corresponding to the tapered outer surface of the first roller, moving a second roller toward the tapered portion of the metal blank being rotated with the first and second dies about the first axis line, the second roller being rotatable about a third axis line parallel to the first axis line, and being movable toward, and away from, the die device in a third direction perpendicular to the first axis line, the second roller having a cylindrical outer surface extending in a fourth direction parallel to the third axis line, and pressing the cylindrical outer surface of the second roller against the tapered portion of the metal blank, so that the second roller cooperates with the first die to sandwich the tapered portion and deforms the tapered portion into the cylindrical portion of the formed body which has a cylindrical outer surface corresponding to the cylindrical outer surface of the second roller.

In the forming process arranged as described above, the first roller which functions as a peeling and rolling roller is used to peel a portion of the original base portion from the remaining portion of the same, and rolling is effected to roll the peeled portion into a tapered portion with a considerably small force. Then, the second roller which functions as a rolling roller is used to bend the tapered portion locally at its root remote from its free end and deform the entirety of the tapered portion into the cylindrical portion of the formed body.

The present forming process does not employ ironing that has been effected using a rolling roller in a conventional forming process, but employs rolling which leads to hardening of only a particular location (i.e., root) of the peeled portion of the metal blank. Therefore, even in the case where a metal blank having a high hardness is formed into a formed body, a peeled portion of the metal blank is effectively prevented from being entirely or excessively hardened.

Thus, in the present forming process, a metal blank can be peeled and rolled into a formed body which is free from defects such as cracks which may be encountered in the conventional forming process. Moreover, the present process which employs the first roller as the peeling and rolling roller is carried out at a lower cost and in a shorter time than the conventional process. Consequently the present process is advantageously used to produce cylindrical products with high efficiency and with high quality, whatever properties the metal blank may have.

According to a preferred feature of the second aspect of the invention, the forming process further comprises the step of preparing the metal blank comprising the original disklike base portion including an original cylindrical projection whose diameter is greater than the diameter of the first die and which projects from a remaining portion of the original disklike base portion, the original cylindrical projection having a predetermined axial length, wherein the step of peeling the portion of the original disklike portion comprises peeling the original cylindrical projection from the remaining portion of the original disklike base portion. In this case, the peeling stroke of the first roller that is substantially equal to the axial length of the cylindrical portion of the formed body may be determined at an appropriate value by taking into account the diameter of the original cylindrical projection, so that the cylindrical portion having a desired inner diameter may be obtained. If the peeling stroke is excessively long, cracks or the like may be produced in the peeled portion. Thus, the cylindrical portion of the formed body is freed of the cracks in the present forming process.

According to another feature of the second aspect of the invention, the step of pressing the second roller against the metal blank comprises pressing the second roller against the metal blank on the first die having a projection on the cylindrical outer surface thereof, so that the second roller cooperates with the first die to sandwich the tapered portion of the metal blank and deforms the tapered portion into the cylindrical portion of the formed body which has the cylindrical inner surface including a recess corresponding to the projection.

According to another feature of the second aspect of the invention, the step of pressing the second roller against the metal blank comprises pressing the second roller against the metal blank on the first die having a recess in the cylindrical outer surface thereof, so that the second roller cooperates with the first die to sandwich the tapered portion of the metal blank and deforms the tapered portion into the cylindrical portion of the formed body which has the cylindrical inner surface including a projection corresponding to the recess. Since the recess(s) and/or projection(s) of the cylindrical portion of the formed body may have a desired one of a variety of shapes, the formed body may find various uses or applications corresponding to the variety of recesses and/or projections.

According to another feature of the second aspect of the invention, the forming process further comprising the steps of moving a third roller toward the tapered portion of the metal blank being rotated with the first and second dies about the first axis line, the third roller being rotatable about a fourth axis line parallel to the first axis line, and being is movable toward, and away from, the die device in a fifth direction perpendicular to the first axis line, the third roller having a tapered outer circumferential surface whose diameter decreases in a sixth direction from one of axially opposite ends thereof on a side of the second die toward the other end thereof on a side of the first die and which defines a second taper angle greater than the first taper angle with respect to a plane perpendicular to the fourth axis line, the third roller having a first annular groove in the tapered outer surface thereof, and pressing the tapered outer surface of the third roller against the tapered portion of the metal blank so that the third roller modifies the tapered portion into a modified tapered portion which has a modified tapered outer surface including an annular ridge corresponding to the first annular groove.

According to another feature of the second aspect of the invention, the step of pressing the second roller against the metal blank comprises pressing the second roller having a second annular groove in the outer cylindrical surface thereof, against the metal blank, so that the second die cooperates with the first die to sandwich the modified tapered portion of the metal blank, force the annular ridge of the modified tapered portion into the second annular groove, and deform the modified tapered portion into the cylindrical portion of the formed body which has the cylindrical outer surface including an annular flange corresponding to the second annular groove. Since the annular flange(s) of the cylindrical portion of the formed body may have a desired one of a variety of shapes, the formed body may find various uses or applications corresponding to the variety of annular flanges.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
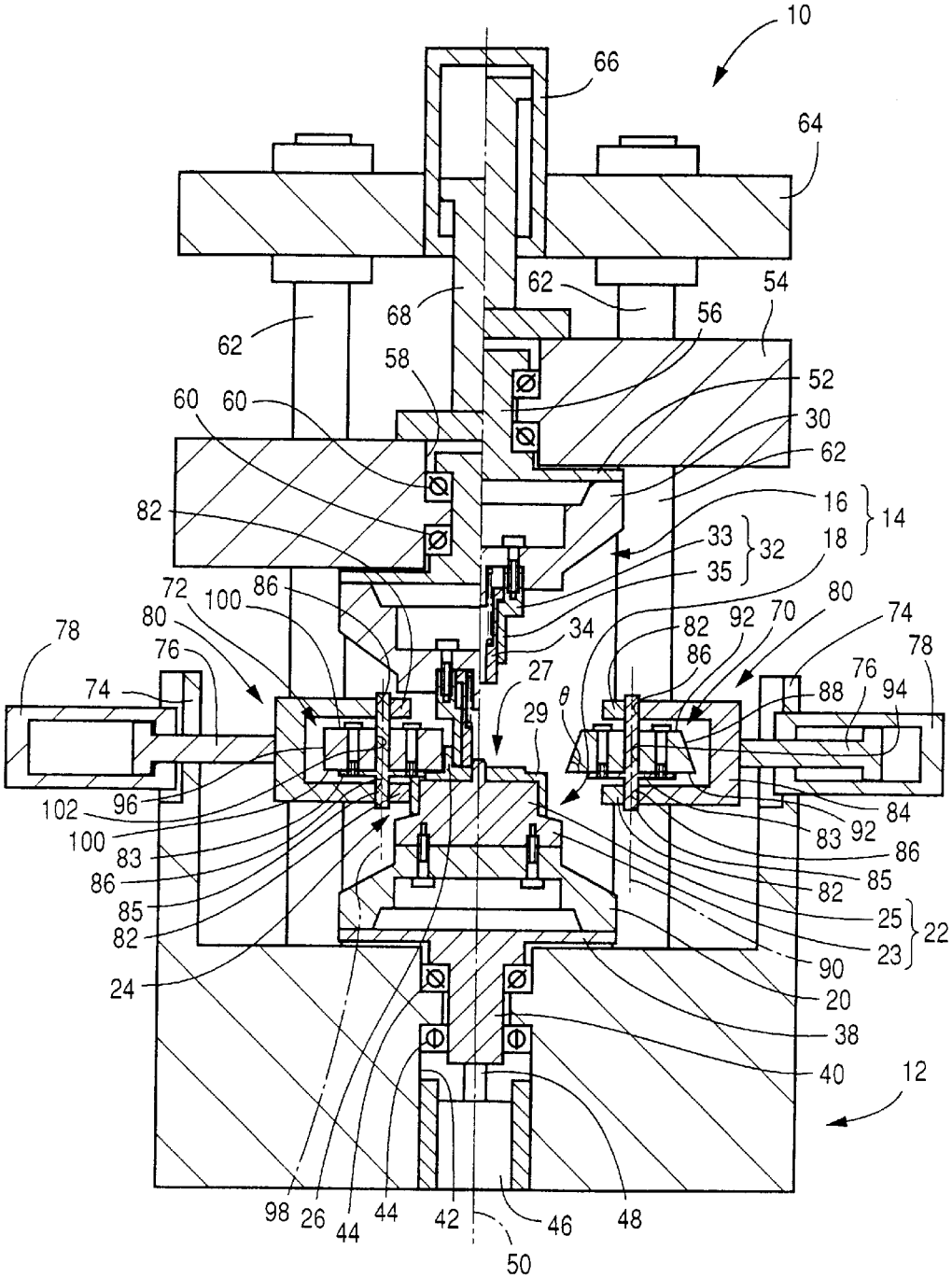
FIG. 1 is a cross section of a forming apparatus in accordance with the present invention, the right-hand half thereof showing a tapered roller in use on the forming apparatus, and a die device being open, the left-hand half thereof showing a straight roller in use in place of the tapered roller and the die device being closed.

Referring first to FIG. 1, there will be described a forming apparatus 10 which forms a metal blank into a formed metal body in the form of a housing of a viscous coupling as a part of an automotive vehicle. The forming apparatus 10 embodies the apparatus in accordance with the present invention and carries out the process in accordance with the present invention. The apparatus 10 includes a base member 12 and a die device 14 provided on the base member 12.

Figure 2:
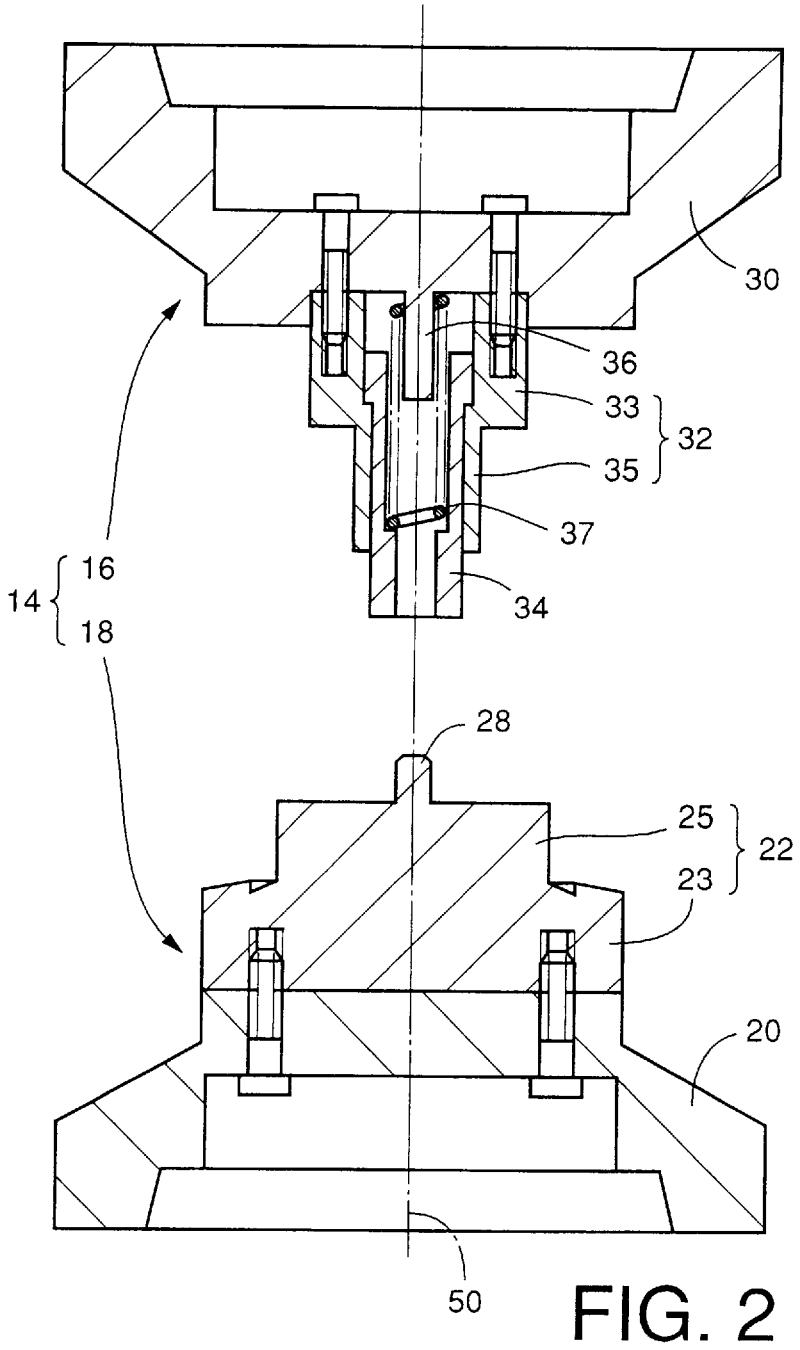
FIG. 2 is a cross section of the die device of the forming apparatus of FIG. 1.

As shown in FIG. 2, the die device 14 includes an upper die 16 as a first die, and a lower die 18 as a second die.

The upper die 16 includes an upper holder 30, an upper pad 32, and a central ejector pin 34. The upper holder 30 has a generally cylindrical shape having an upper large-diameter portion, an intermediate tapered portion, and a lower small-diameter portion.

Figure 6:
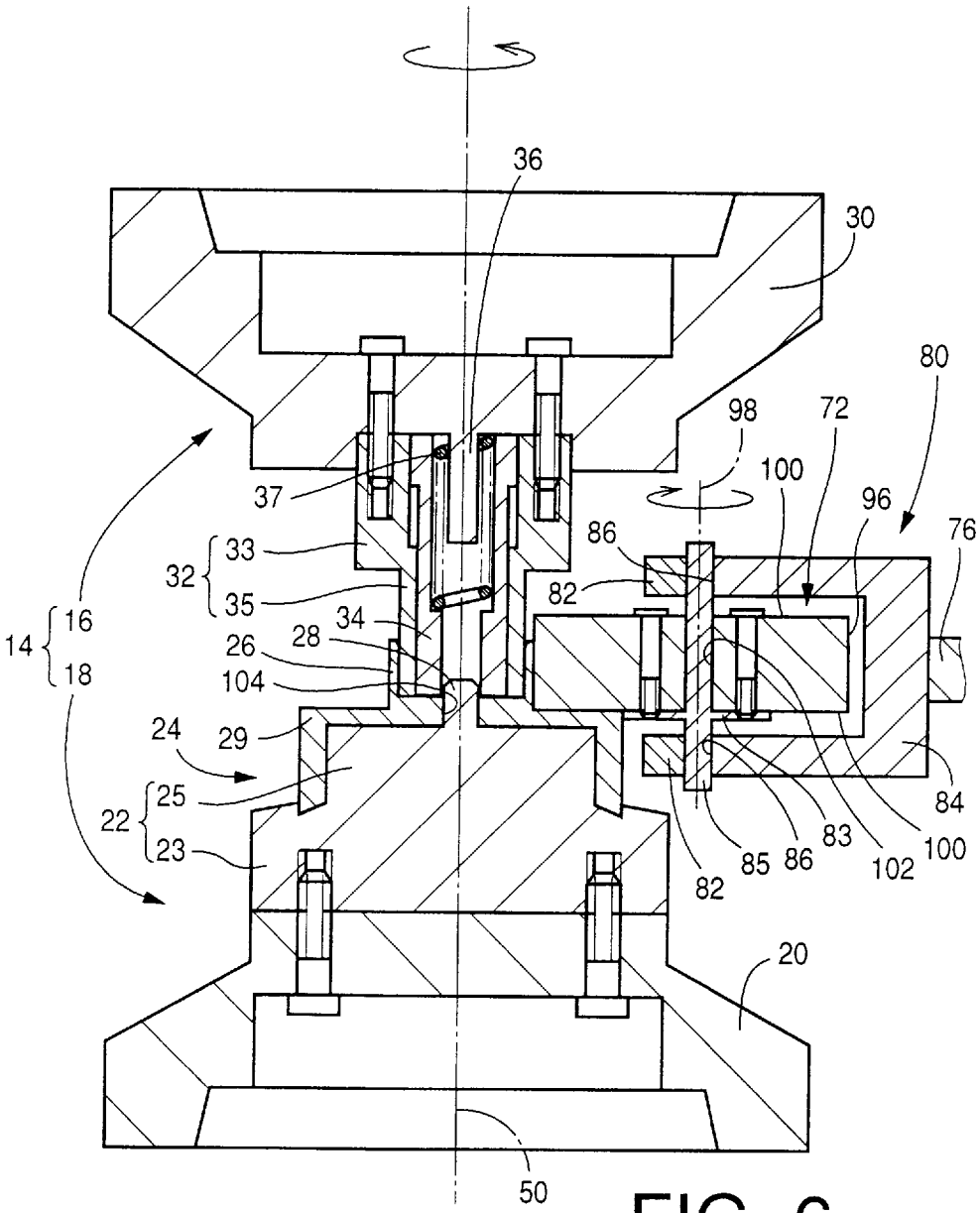
FIG. 6 is a view illustrating another step of the invention process in which the straight roller is pressed against the tapered portion of the metal blank, so as to deform the tapered portion into a cylindrical portion.
Figure 7:
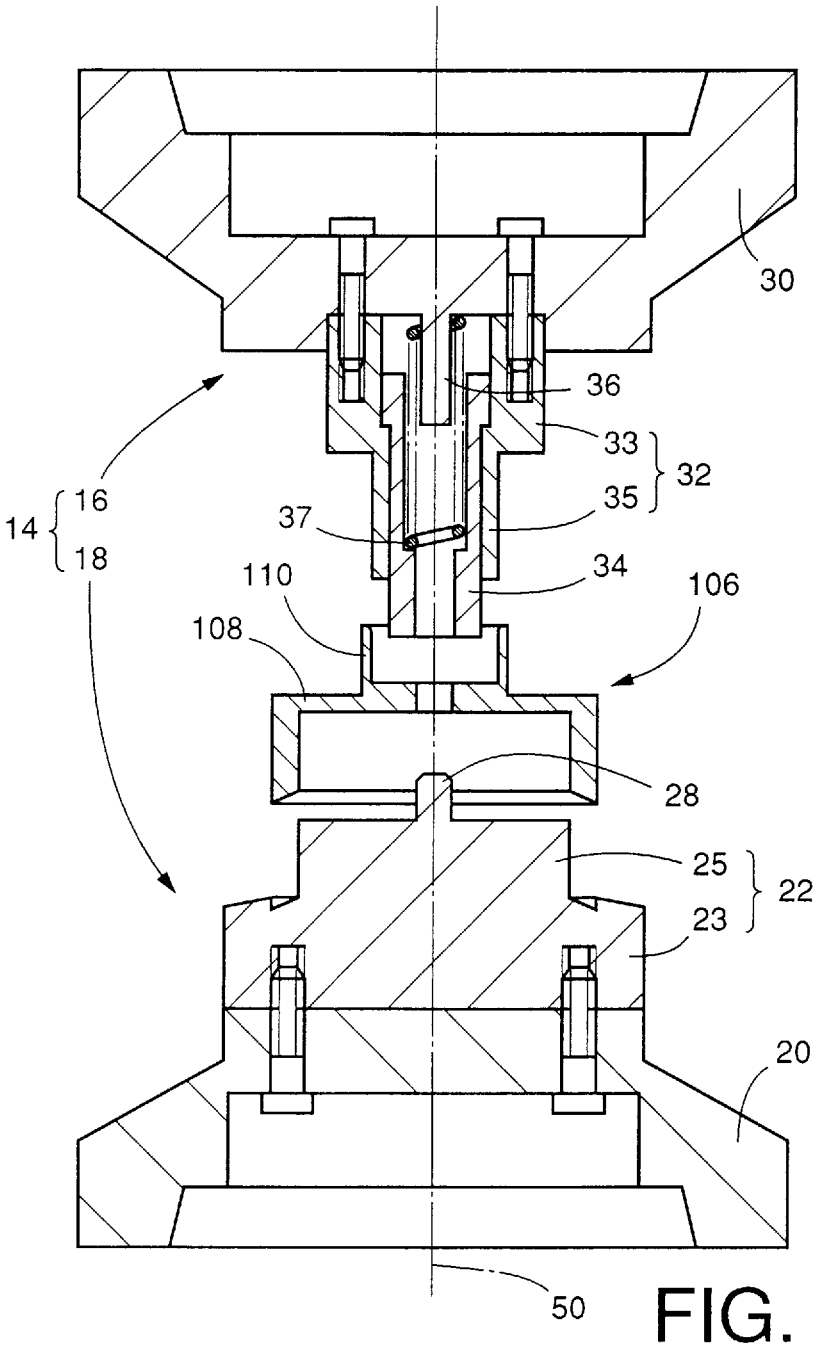
FIG. 7 is a view illustrating another step of the invention process in which a formed metal body is ejected from the die device.

The upper pad 32 has a stepped cylindrical shape having an upper large-diameter portion 33 whose diameter is smaller than that of the lower small-diameter portion of the upper holder 30. The upper pad 32 also has a lower small-diameter portion 35 whose diameter is smaller than that of the large-diameter portion 33. As shown in FIG. 6, the diameter of the lower portion 35 is equal to an inner diameter of a cylindrical portion 26 of the viscous-coupling housing obtained from a metal blank 24, and the axial length of the lower portion 35 is greater than that of the cylindrical portion 26. The upper surface of the upper pad 32 is fixed with bolts to the lower surface of the upper holder 30 such that a spring support pin 36 projecting from a central portion of the lower surface of the upper holder 30 coaxially extends in an inner hole formed in the upper portion 33 of the upper pad 32.

The central ejector pin 34 has the same axial length as that of the upper pad 32, and has a stepped cylindrical shape having a large-diameter portion being slideably fit in the inner hole of the upper portion 33 of the upper pad 32, and a small-diameter portion being slideably fit in an inner hole formed in the small-diameter portion 35 of the same pad 32. The spring support pin 36 coaxially extends in an inner hole formed in the large-diameter portion of the ejector pin 34. The ejector pin 34 is slideable relative to the upper pad 32 over a predetermined distance in the axial direction of the pin 34. A compression coil spring 37 is accommodated in the inner hole of the ejector pin 34 such that the spring support pin 36 extends through the spring 37, one end of the spring 37 is engaged with an inner stepped portion of the ejector pin 34 and the other end of the spring 37 is engaged with the lower surface of the upper holder 30. The spring 37 exerts a predetermined biasing force to the ejector pin 34 in a downward direction in which the pin 34 projects from the inner hole of the lower portion 35 of the upper pad 32. With the ejector pin 34 being ejected at a predetermined ejected position, the outer stepped portion of the pin 34 engages the inner stepped portion of the upper pad 32, so that the pin 34 is effectively prevented from coming down off the inner hole of the upper pad 32.

The lower die 18 includes a lower holder 20 and a lower pad 22. The lower holder 20 has substantially the same shape as that of the upper holder 30, and is opposed to the upper holder 30 such that the upper and lower holders 30, 20 are coaxial with each other.

The lower pad 22 has a generally cylindrical shape including a lower large-diameter portion 23 and an upper small-diameter portion 25. The lower pad 22 is fixed at its lower surface (i.e., lower surface of the large-diameter portion 23) to an upper surface of a small-diameter portion of the lower holder 20 with bolts, such that the lower pad 23 and the lower holder 20 are coaxial with each other. Thus, the lower die 18 is provided by the lower holder and pad 22, 20 which are integrally assembled. The lower die 18 is coaxial with, and opposed to, the upper die 16. The lower pad 22 has a central projection 28 projecting from the center of upper surface of the small-diameter portion 25. The central projection 28 has an outer diameter which is slightly smaller than an inner diameter of the central ejector pin 34 of the upper die 16, and has an axial length which is greater than the thickness of the metal blank 24, as shown in FIG. 1. When the upper die 16 is moved toward the lower die 18, the central projection 28 of the lower die 18 enters the inner hole of the central ejector pin 34 of the upper die 16, as described later.

As shown in FIG. 1, the lower holder 20 of the lower die 18 is fixed to an upper surface of a lower support plate 38, which includes a generally cylindrical axis portion 40 projecting from the center of lower surface of the plate 40 such that the axis portion 40 is coaxial with the lower die 18. The axis portion 40 projects into a motor accommodating hole 42 which is formed through the thickness of the center of the base member 12. A plurality of bearings 44 are fixed to an upper portion of the hole 42, and an electric motor 46 is fixed to a lower portion of the hole 42. The axis portion 40 of the lower support plate 38 is rotatably supported by the bearings 44, and is coaxially connected to an output shaft 48 of the motor 46. When the motor 46 is driven or rotated, the lower support plate 38 and the lower die 18 are rotated as a whole about the output shaft 48 of the motor 46, that is, an axis line 50 of the lower die 18.

Meanwhile, the upper holder 30 of the upper die 16 is fixed to a lower surface of an upper support plate 52, which is rotatably supported by an upper movable plate 54 which is provided above the base member 12 and is opposed to the same 12. The upper support plate 52 includes a generally cylindrical axis portion 56 which projects from the center of upper surface of the plate 52 such that the axis portion 56 is coaxial with the upper die 16. The axis portion 56 enters a through-hole 58 which is formed through the center of the upper movable plate 54 and which is concentric with the motor accommodating hole 42 of the base member 12. The axis portion 56 is rotatably supported by a plurality of bearings 60 provided in the through-hole 58.

The upper movable plate 54 which supports the upper support plate 52 such that the support plate 52 is rotatable about the axis line 50, is supported by a plurality of guide posts 62 extending upward from an outer peripheral portion of the base member 12 while surrounding the support plate 52, such that the movable plate 54 is slideable or movable upward and downward. A stationary plate 64 is fixed to respective upper end portions of the guide posts 62, and supports, at the center thereof, a first hydraulic cylinder 66 including a piston rod 68 which is advanced toward the base member 12 by a hydraulic pressure source (not shown). A lower end of the piston rod 68 is fixed to an upper surface of the upper movable plate 54.

Thus, the upper die 16 is rotatable together with the upper support plate 52 about the axis line 50 common to the lower die 18. In addition, when the piston rod 68 of the first hydraulic cylinder 66 is advanced and retracted, the upper support plate 52 and the upper movable plate 54 are moved up and down together with each other.

Thus, the die device 14 includes the upper and lower dies 16, 18 which are coaxial with each other, and the upper die 16 18 moved toward, and away from, the lower die 18 when the piston rod 68 of the first hydraulic cylinder 66 is advanced and retracted, respectively. When the upper die 16 is moved toward the lower die 18, the metal blank 24 which is concentrically placed on the lower pad 22 of the lower die 18 and which will give an aimed viscous-coupling housing, is concentrically sandwiched between the lower pad 22 of the lower die 18 and the central ejector pin 34 and the upper pad 32 of the upper die 16. More specifically described, the metal blank 24 includes an original disklike base portion 29 which includes an original cylindrical projection 27 projecting from the remaining portion of the base portion 29, and the cylindrical projection 27 is sandwiched between the upper and lower dies 16, 18. With the metal blank 24 being sandwiched, the electric motor 46 is driven or rotated, so that the upper and lower dies 16, 18 are rotated with each other about the axis line 50 as a first axis line while sandwiching the metal blank 24.

The present forming apparatus 10 additionally includes two rolling rollers in the form of a tapered roller 70 and a straight roller 72 which are selectively or alternately attached to the base member 12 on which the die device 14 is supported, though the two rollers 70, 72 are simultaneously shown in FIG. 1.

A cylinder support portion 74 having a predetermined height projects upward from the outer peripheral portion of the base member 12, between two of the guide posts 62. A second hydraulic cylinder 78 having a piston rod 76 is supported by an upper portion of the cylinder support portion 74. The piston rod 78 is advanced toward, and retracted from, the die device 14 by a hydraulic pressure source (not shown) in a direction perpendicular to the axis line 50. A clamp 80 having a generally U-shaped cross section is fixed to a free end of the piston rod 76 such that the clamp 80 is opposed to the die device 14. The clamp 80 includes an upper and a lower end portion 82, 82 which are detachably attached to a base portion 84 of the clamp 80 with screws (not shown). Two vertical holes 86 are formed in the respective interfaces between the two end portions 82 and the base portion 84 of the clamp 80, such that the two holes 86 are vertically opposed to each other. A roller support axis member 85 is supported by the two holes 96, 86 such that the axis member 85 extends parallel to the axis line 50 of the die device 14 and is rotatable about its axis line 90. A roller support plate 83 is formed integrally with the axis member 85.

Figure 5:
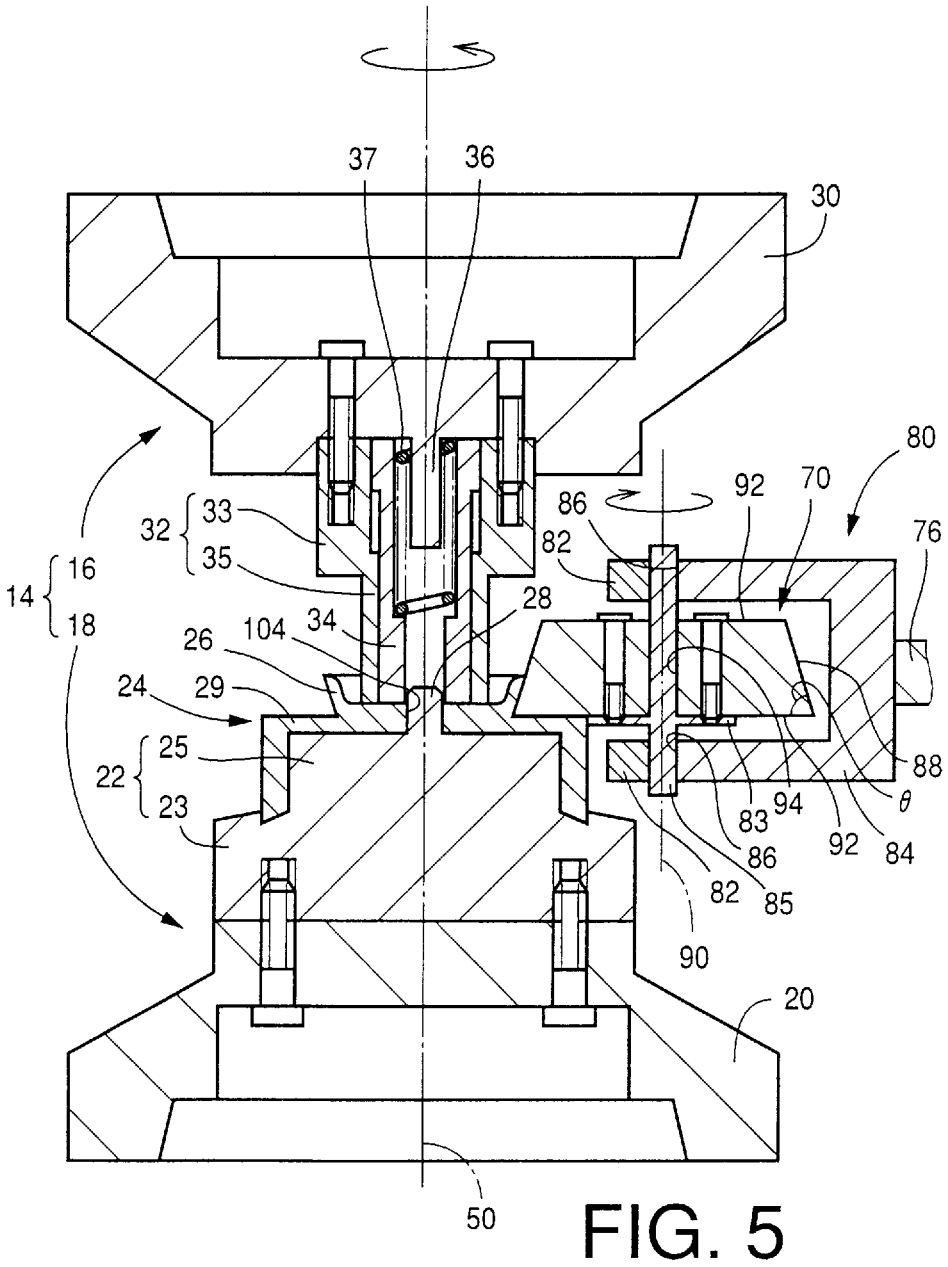
FIG. 5 is a view illustrating yet another step of the invention process in which the tapered roller is pressed against a portion of the metal blank being sandwiched between, and rotated with, the first and second dies, so as to peel the portion from the remaining portion of the blank and deform the peeled portion into a tapered portion.

The tapered roller 70 has a truncated cone shape having a tapered outer surface 88 whose diameter gradually decreases in an upward direction from the lower die 18 toward the upper die 16, and an upper and a lower end face 92, 92 which extend perpendicular to the axis line 90 as shown in FIG. 5. The tapered roller 70 has a central through-hole 94 through which the roller support axis member 85 of the clamp 80 vertically extends. The tapered roller 70 has a taper angle, $\theta$, of 70 degrees ($\theta$=70°) defined by the tapered outer surface 88 and the lower end face 92.

The tapered roller 70 is fixed with bolts to the roller support plate 83, with the roller support axis member 85 extending through the through-hole 94 of the roller 70. Thus, the tapered roller 70 is supported by the clamp 80 such that the roller 70 is rotatable about the axis line 90 as a second axis line parallel to the first axis line 50.

The piston rod 76 of the second hydraulic cylinder 78 is advanced toward, and retracted, from the upper die 16 of the die device 14 while the tapered outer surface 88 of the tapered roller 70 is opposed to the small-diameter portion 35 of the upper pad 32 which is positioned, when the metal blank 24 is sandwiched by the upper and lower dies 16, 18, between the large-diameter portion 33 of the upper pad 32 of the upper die 16 and the small-diameter portion 25 of the lower pad 22 of the lower die 18.

The straight roller 72 has a cylindrical shape having a cylindrical outer surface 96 which extends in a vertical direction and whose diameter is constant, and an upper and a lower end face 100, 100 which extends perpendicular to its axis line 98, as shown in FIG. 6. The straight roller 72 has a vertical through-hole 102 through which the roller support axis member 85 of the clamp 80 extends. The outer diameter of the straight roller 72 or the outer cylindrical surface 96 is substantially equal to that of the tapered roller 72 at the lower end face 92 thereof.

Like the tapered roller 70, the straight roller 72 is fixed with bolts to the roller support plate 83, with the roller support axis member 85 extending through the through-hole 102 of the roller 72. Thus, the straight roller 72 is supported by the clamp 80 such that the roller 72 is rotatable about the axis line 98 as a third axis line parallel to the first axis line 50.

Like the tapered roller 70, the piston rod 76 of the second hydraulic cylinder 78 is advanced toward, and retracted, from the upper die 16 of the die device 14 while the cylindrical outer surface 96 of the straight roller 72 is opposed to the small-diameter portion 35 of the upper pad 32 which is positioned, when the metal blank 24 is sandwiched by the upper and lower dies 16, 18, between the large-diameter portion 33 of the upper pad 32 of the upper die 16 and the small-diameter portion 25 of the lower pad 22 of the lower die 18.

In the forming apparatus 10, the tapered roller 70 is set on the clamp 80, so that when the piston rod 76 of the second hydraulic cylinder 78 is advanced toward the die device 14, the tapered roller 70 is moved or transferred toward the upper die 16 which cooperates with the lower die 18 to sandwich the metal blank 24. More specifically described, while the metal blank 24 is rotated with the upper and lower dies 16, 18 about the first axis line 50, the tapered roller 70 is rotated in a direction opposite to the direction of rotation of the dies 16, 18, and the tapered outer surface 88 is pressed against a cylindrical outer surface of the cylindrical projection 27 of the original base portion 29 of the metal blank 24 sandwiched between the two dies 16, 18. Thus, the cylindrical projection 27 is partly peeled by the tapered roller 70, and the peeled portion has a tapered outer surface. Subsequently, the straight roller 72 is set on the clamp 80, in place of the tapered roller 70, so that the straight roller 72 is moved or transferred toward the upper die 16 which cooperates with the lower die 18 to sandwich the metal blank 24. More specifically described, while the metal blank 24 is rotated with the upper and lower dies 16, 18 about the first axis line 50, the straight roller 72 is rotated in a direction opposite to the direction of rotation of the dies 16, 18, and the cylindrical outer surface 96 is pressed against the tapered outer surface of the peeled portion of the cylindrical projection 27 sandwiched between the two dies 16, 18, and cooperates with the cylindrical outer surface of the small-diameter portion 35 of the upper pad 32 of the upper die 16 to sandwich the peeled portion of the cylindrical projection 27.

In the forming apparatus 10 constructed as described above, first, the tapered outer surface of the tapered roller 70 is pressed against the outer surface of the cylindrical projection 27 of the metal blank 24, so that a radially outer portion 26 of the cylindrical projection 27 is peeled upward off the remaining portion of the disklike base portion 29 of the metal blank 24, by the lower end of the roller 70 or outer surface 88 which has the greatest outer diameter, and so that the peeled portion 26 is raised at the angle of 70° by the entirety of the tapered outer surface 88 of the roller 70. Thus, the peeled 26 is deformed into a tapered portion having a tapered outer surface corresponding to the tapered outer surface 88 of the roller 70. Subsequently, the thus obtained peeled or tapered portion 26 is pressed by the straight roller 72, so that the tapered portion 26 is bent radially inward at its lower end. Thus, the tapered portion 26 is deformed into a cylindrical portion having a cylindrical outer surface corresponding to the cylindrical outer surface of the straight roller 72. That is, the forming apparatus 10 provides a formed metal body in the form of a viscous-coupling housing including a disklike base portion and a cylindrical portion which is formed on an outer surface of the base portion such that the cylindrical portion is integral with, and concentric with, the base portion.

As is apparent from the foregoing description, the present forming apparatus 10 presses first the tapered roller 70 and then the straight roller 72 against the cylindrical projection 27 of the metal blank 24 in the direction perpendicular to the axis line 50 of the metal blank 24, but need not further press the roller 70, 72 against the peeled or tapered portion 26 in an axial direction thereof. This is in stark contrast to a conventional forming apparatus in which a metal blank is ironed by a rolling roller. The pressing force with which the tapered and straight rollers 70, 72 are pressed against the metal blank 24 is smaller than that with which the rolling roller is pressed in the axial direction of the metal blank in the conventional apparatus. In addition, since the straight roller 72 bends only the lower end portion of the peeled or tapered portion 26 for deforming the tapered portion 26 into the cylindrical portion. Thus, only the bent lower end of the cylindrical portion is hardened. Accordingly, even in the case where the metal blank 24 is a hard metal material, the cylindrical portion formed from the peeled portion 26 of the cylindrical projection 27 of the metal blank 24 is effectively prevented from being excessively hardened or deteriorated due to the forming or working. Thus, the present forming apparatus 10 can produce a viscous-coupling housing at a low cost and in a short time, irrespective of the sort of metal blank 24. The housing as the formed body is free from defects such as cracks resulting from the forming or working of the metal blank.

Next there will be described the operation of the forming apparatus 10 for producing a viscous-coupling housing.

Figure 3:
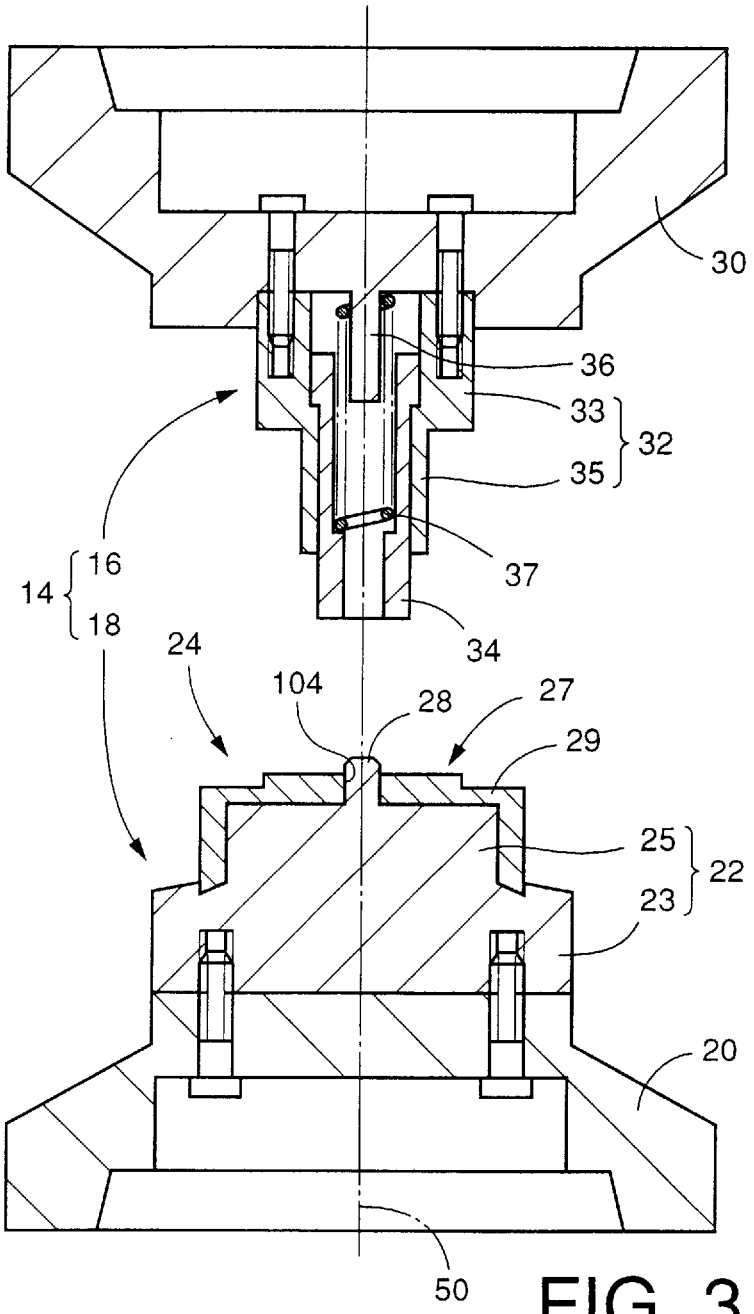
FIG. 3 is a view illustrating one step of a forming process in accordance with the present invention, in which a metal blank is set on the die device being open.

First, as shown in FIG. 3, a metal blank 24 which is to be formed into an aimed viscous-coupling housing is set on the die device 14 which is placed in an "open" position where the upper die 16 is retracted away from the lower die 18. More specifically described, the metal blank 24 has a generally cylindrical shape, and includes an original disklike bottom or base portion 29 which is to be formed into a disklike base portion of the viscous-coupling housing as an end product. The original disklike base portion 29 includes an original cylindrical projection 27 projecting from a central portion of an outer surface thereof. The cylindrical projection 27 is formed in advance by subjecting the base portion 29 to cutting or press bending. The diameter of the cylindrical projection 27 is determined depending upon the axial length of the cylindrical portion of the aimed housing. Thus, the original base portion 29 has a "stepped" cylindrical shape. The base portion 29 has a central hole 104 formed through the thickness thereof. The metal blank 24 is set on the small-diameter portion 25 of the lower pad 22 of the lower die 18, such that the central projection 28 projecting from the lower pad 22 extends through the central hole 104 of the metal blank 24. Thus, the metal blank 24 is concentrically set on the lower die 18.

Figure 4:
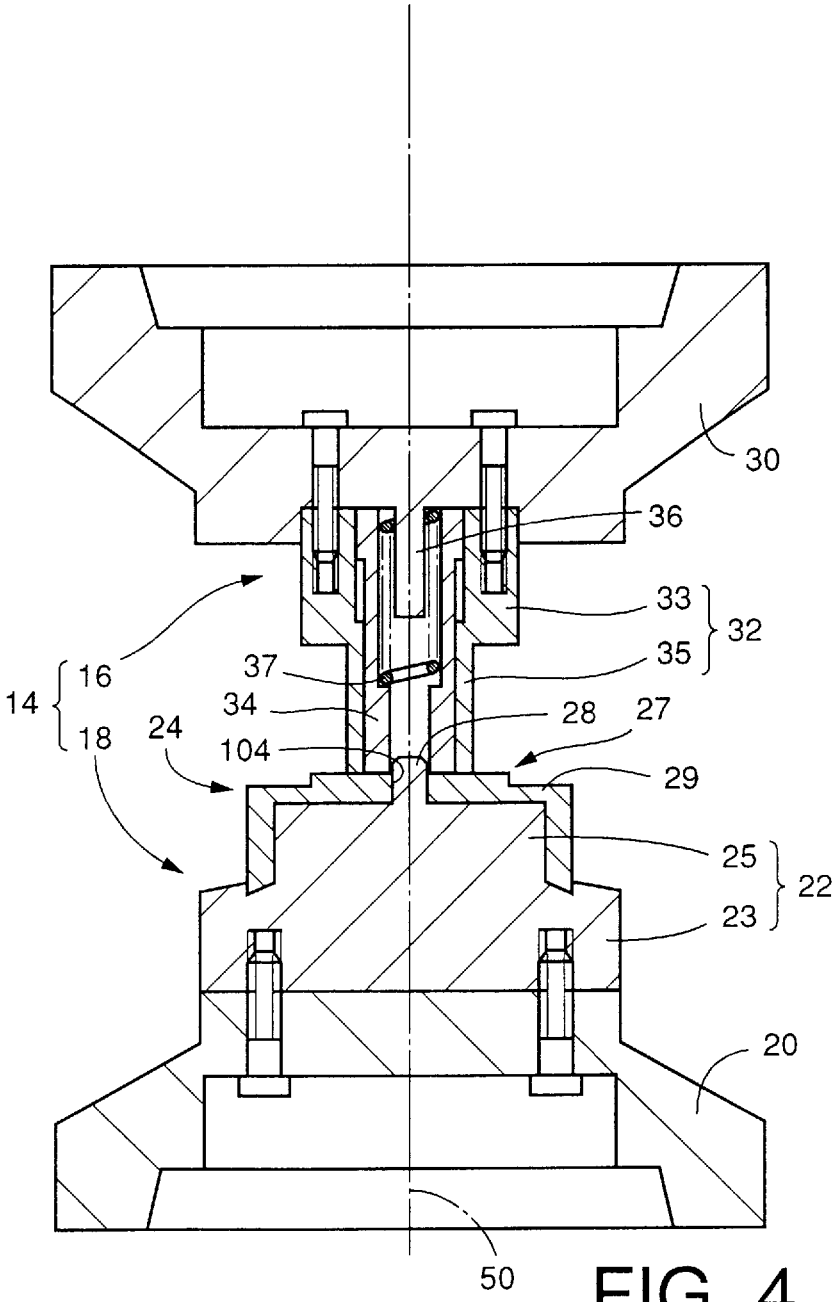
FIG. 4 is a view illustrating another step of the invention process in which the metal blank is sandwiched between a first and a second die of the die device being closed.

Subsequently, the piston rod 68 of the first hydraulic cylinder 66 is advanced downward to move the upper movable plate 54 downward. Thus, as shown in FIG. 4, the central projection 28 of the lower pad 22 which extends through the center hole 104 of the metal blank 24 enters, at the upper end portion thereof, the inner hole of the central ejector pin 34. When the upper movable plate 54 is further moved downward, the ejector pin 34 contacts the cylindrical projection 27 of the metal blank 24 set on the lower pad 22, and then the upper pad 32 is further moved downward while the ejector pin 34 is retracted into the inner hole of the upper pad 32 against the biasing force of the spring 37. Thus, the upper pad 32 and the ejector pin 34 are held in pressed contact with the cylindrical projection 27 of the metal blank 24. Thus, the cylindrical projection 27 is concentrically sandwiched between the upper and lower dies 16, 18.

When the electric motor 46 which is connected to the lower holder 20 of the lower die 18 via the lower support plate 38 is driven or rotated, the lower die 18 is rotated as a whole. Thus, as shown in FIG. 5, the upper and lower dies 16, 18 are rotated with each other about the first axis line 50 while sandwiching the metal blank 24. Meanwhile, when the piston rod 76 of the second hydraulic cylinder 78 is advanced toward the first axis line 50, the clamp 80 which is fixed to the free end of the piston rod 76 is moved or transferred toward the die device 14. Thus, the tapered outer surface 88 of the tapered roller 70 which is rotatably supported by the clamp 80 is pressed against the outer surface of the cylindrical projection 27 projecting from the original base portion 29 of the metal blank 24 which is being rotated with the first and second dies 16, 18 about the axis line 50. The tapered roller 70 is passively rotated about the second axis line 90 in a direction opposite to the direction of rotation of the metal blank 24. Thus, the cylindrical projection 27 of the metal blank 24 is gradually peeled from the remaining portion of the base portion 29, by the lower end portion of the tapered roller 70 or the tapered outer surface 88 thereof, that is, angled end portion having the maximum diameter, and the peeled portion 26 is raised up along the tapered outer surface 88 of the tapered roller 70. Consequently the peeled portion 26 has a tapered shape having a tapered outer surface corresponding to the tapered outer surface 88 of the tapered roller 70.

Next, the piston rod 76 of the second hydraulic cylinder 78 is retracted away from the die device 14, so that the tapered roller 70 is retracted away from the metal blank 24. Then, the straight roller 72 is attached to the clamp 80, in place of the tapered roller 70. Again, the piston rod 76 is advanced toward the die device 14. Thus, as shown in FIG. 6, the cylindrical outer surface 96 of the straight roller 72 is pressed against the tapered outer surface of the peeled portion 26 of the metal blank 24 which is being rotated with the upper and lower dies 16, 18 about the first axis line 50. Consequently the peeled portion 26 is sandwiched between the outer surface 96 of the straight roller 72 and the outer surface of the small-diameter portion 35 of the upper pad 32. The straight roller 72 is passively rotated about the third axis line 98. Thus, the peeled portion 26 is bent at its lower end portion thereof by the lower end portion of the straight roller 72, and the entirety of the peeled portion 26 is deformed by the entirety of the straight roller 72, so that the entirety of the peeled portion 26 is formed into a cylindrical shape.

Thus, the forming apparatus 10 forms the metal blank 24 into an aimed viscous-coupling housing 106 including a disklike base portion 108 corresponding to the original base portion 29 of the metal blank 24, and a cylindrical portion 110 which is formed from the peeled portion 26 of the metal blank 24 on the outer surface of the base portion 108 such that the cylindrical portion 110 is integral, and concentric, with the base portion 108. Then, the piston rod 76 of the second hydraulic cylinder 78 is retracted, and the piston rod 68 of the first hydraulic cylinder 66 is retracted. Thus, the upper die 16 is moved upward away from the lower die 18, and the center ejector pin 34 is advanced downward out of the inner hole of the upper pad 32 by the biasing force of the spring 37. Consequently the viscous-coupling housing 106 is ejected from the upper die 16 of the die device 14.

In the peeling and rolling operation carried out by the present forming apparatus 10, the peeled portion 26 of the metal blank 24 can be deformed into the cylindrical portion 110 of the housing 106, with a smaller force than that needed in a conventional forming apparatus in which ironing is carried out by a peeling and rolling roller. In addition, rolling-induced hardening occurs to only a particular portion (i.e., lower end portion) of the peeled portion 26. That is, only the lower end portion of the cylindrical portion 110 is hardened. For those reasons, the peeled portion 26 of the metal blank 24 is effectively prevented from being entirely or excessively hardened due to the rolling operation, irrespective of the sort of the metal blank 24. Thus, the present forming apparatus 10 can produce an excellent viscous-coupling housing 106 at a low cost and in a short time. The housing 106 as the formed body is free from defects such as cracks resulting from the peeling and rolling operation. The forming apparatus 10 practices economy and enjoys a high productivity.

The present peeling and rolling process employs the metal blank 24 having the original disklike base portion 29 including the original cylindrical projection 27 which is formed in advance by machining the base portion 29. The cylindrical projection 27 projects from the central portion of the outer surface of the base portion 29. Since the projection 27 has the diameter which is determined in advance by taking into account the axial length of the cylindrical portion 110 of the viscous-coupling housing 106 to be formed from the metal blank 24, the projection 27 can be peeled by the tapered roller 70 which is moved over a minimum peeling stroke thereof. Thus, the cylindrical portion 110 is effectively freed of cracks which may result from an excessively long peeling stroke.

Referring next to FIGS. 8 to FIG. 17, there will described a second embodiment of the present invention. The second embodiment relates to a forming apparatus for forming a metal blank into a pulley including a boss portion. The pulley is used as a part of an automotive vehicle. The second forming apparatus is different from the first forming apparatus 10 only in that the second apparatus employs a die device different from the die device 14 of the first apparatus 10. Therefore, the die device of the second apparatus is shown in enlargement in FIGS. 8, 10, and 12. The same reference numerals as used in the first embodiment shown in FIGS. 1–7 are used to designate the corresponding elements or parts of the second apparatus, and the description thereof is omitted from the following description.

Figure 8:
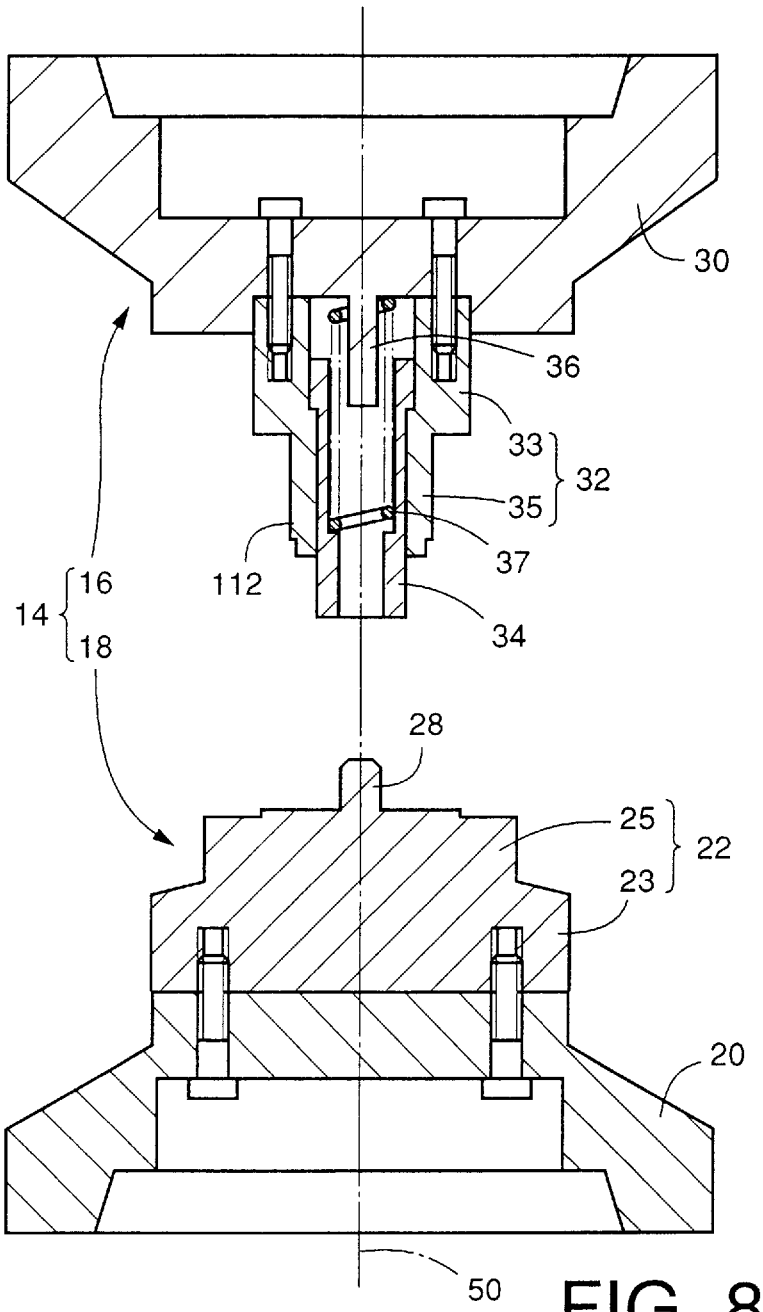
FIG. 8 is a cross section of a modified die device which may be employed in another forming apparatus as a second embodiment of the present invention.

The second forming apparatus has a die device 14 including an upper die 16 and a lower die 18, and a tapered roller 70 and a straight roller 72 both of which are not shown in FIG. 8. The two rollers 70, 72 of the second forming apparatus are identical with those 70, 72 of the first forming apparatus 10. However, in the second apparatus, the upper pad 32 of the upper die 16 is different from that of the first apparatus in that the small-diameter portion 35 of the upper pad 32 has an axially elongate projection 112 on the cylindrical outer surface thereof. The axial projection 112 is for forming a key groove in the boss portion of the pulley. The axial projection 112 continuously extends vertically downward from the lower end of the large-diameter portion 33 of the upper pad 32 toward the lower end of the small-diameter portion 35 of the same 32, and has predetermined length, width and height.

Like in the first embodiment, the upper die 16 of the second embodiment is moved toward the lower die 18 to sandwich a metal blank 114 (FIG. 9) giving an aimed pulley including a boss portion, and the two dies 16, 18 are rotated about the first axis line 50 while sandwiching the metal blank 114. The metal blank 114 includes a cylindrical projection 27 which is formed in advance by, e.g., press bending (or die bending).

Also like in the first embodiment, the cylindrical projection 27 is peeled from the metal blank 114 and is deformed into a tapered portion by the tapered roller 70, and the peeled or tapered portion 26 is deformed into a cylindrical portion 110. In particular, when the tapered portion 26 is sandwiched between the cylindrical outer surface of the small-diameter portion 35 of the upper pad 32 of the upper die 16 and the cylindrical outer surface of the straight roller 72 and thus is deformed into the cylindrical portion 110, the inner surface of the tapered portion 26 is deformed or recessed by the axial projection 112 of the upper pad 32, so that a recess in the form of a key groove 116 corresponding to the axial projection 112 is formed in the inner surface of the cylindrical portion 110.

Thus, the second forming apparatus enjoys not only the same advantages as those of the first forming apparatus 10 but also another advantage that the key groove 116 is formed in the inner surface of the cylindrical portion 110 when the cylindrical projection 27 of the metal blank 114 is formed into the cylindrical portion 110. Thus, the second forming apparatus can produce the pulley including the boss portion having the key groove 116, with high efficiency and productivity.

Next, there will be described the operation of the second forming apparatus for producing the pulley including the boss portion.

Figure 9:
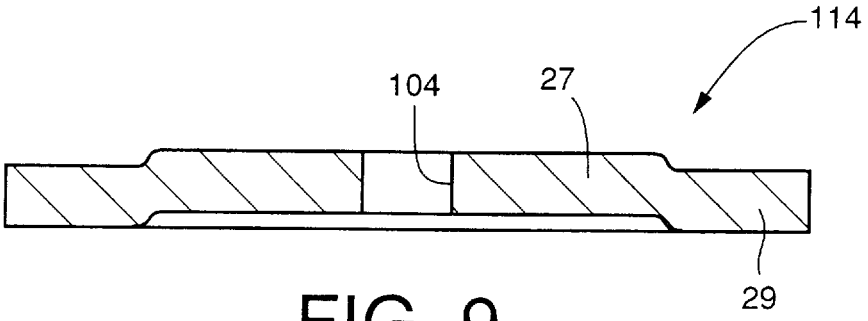
FIG. 9 is a cross section of a different metal blank which may be formed into a formed body by the second forming apparatus employing the modified die device of FIG. 8.

First, the metal blank 114 as shown in FIG. 9 is prepared in advance. The metal blank 114 has a generally disklike shape including an original base portion 29 which is to be formed into a base portion of an aimed pulley including a boss portion, and a cylindrical projection 27 which is provided on an outer surface of the base portion 29 by subjecting the base portion 29 to, e.g. press bending. Thus, the metal blank 114 has a stepped cylindrical shape.

Figure 10:
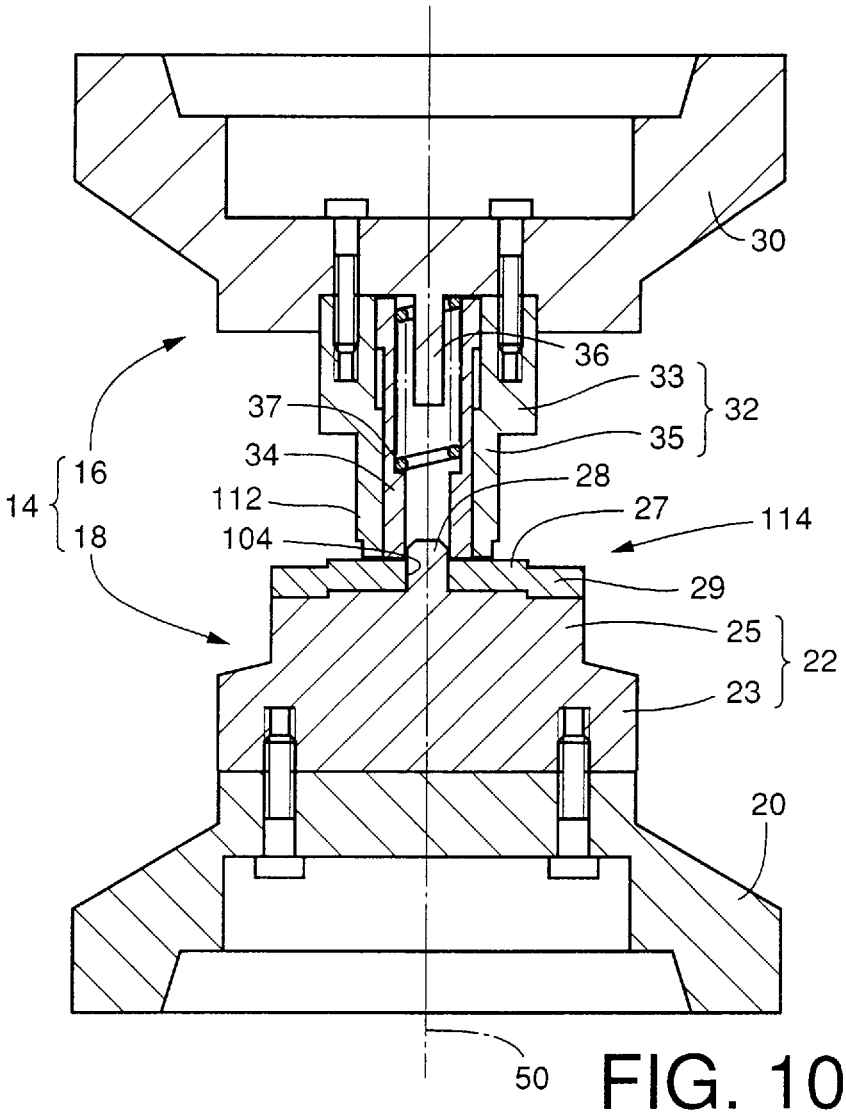
FIG. 10 is a view illustrating one step of a second invention process in which the metal blank of FIG. 9 is sandwiched between the first and second dies of the die device of FIG. 8.

As shown in FIG. 10, the metal blank 114 is concentrically sandwiched between the lower pad 22 of the lower die 18 and the upper pad 32 and center ejector pin 34 of the upper die 16, and is rotated with the two dies 16, 18 about the first axis line 50 by the electric motor 46.

Figure 11:
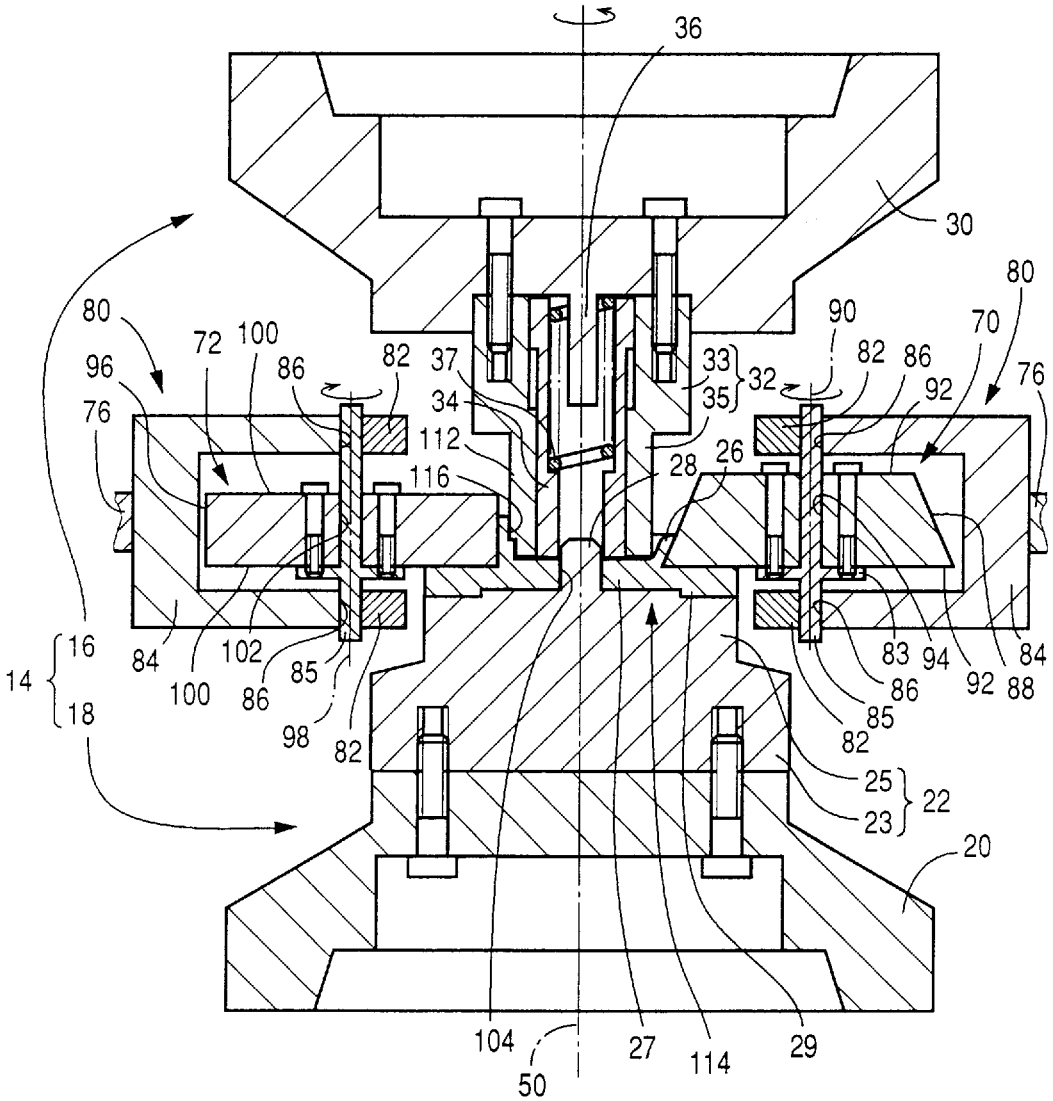
FIG. 11 is a view illustrating additional steps of the second invention process, the right-hand half showing the step in which the tapered roller peels a portion of the metal blank of FIG. 9, the left-hand half showing the step in which the straight roller deforms the peeled portion into a cylindrical portion.

Subsequently, as shown in the right-hand half of FIG. 11, the tapered roller 70 is moved or transferred toward the die device 14, so that the tapered outer surface 88 of the roller 70 is pressed against the outer surface of the cylindrical projection 27 of the metal blank 114 which is being rotated with the dies 16, 18 about the axis line 50. Thus, the projection 27 is peeled from the base portion 29 of the metal blank 114, and the peeled portion 26 is deformed into a tapered portion having a tapered outer surface corresponding to the tapered outer surface 88 of the roller 70.

Subsequently, as shown in the left-hand half of FIG. 11, the tapered roller 70 is replaced by the straight roller 72, and the straight roller 72 is moved or transferred toward the die device 14 so that the cylindrical outer surface 96 of the roller 72 is pressed against the tapered outer surface of the peeled portion 26 and cooperates with the outer surface of the small-diameter portion 35 of the upper pad 32 of the upper die 16 to sandwich the peeled portion 26. Thus, the peeled portion 26 is bent at its lower end portion by the lower end portion of the straight roller 72, and the entirety of the peeled portion 26 is deformed into the cylindrical portion 110 by the entirety of the roller 72. In this process, the axial projection 112 provided integrally with the small-diameter portion 35 of the upper pad 32 operates for forming the key groove 116 in the inner surface of the cylindrical portion 110 formed from the peeled portion 26.

Figure 12:
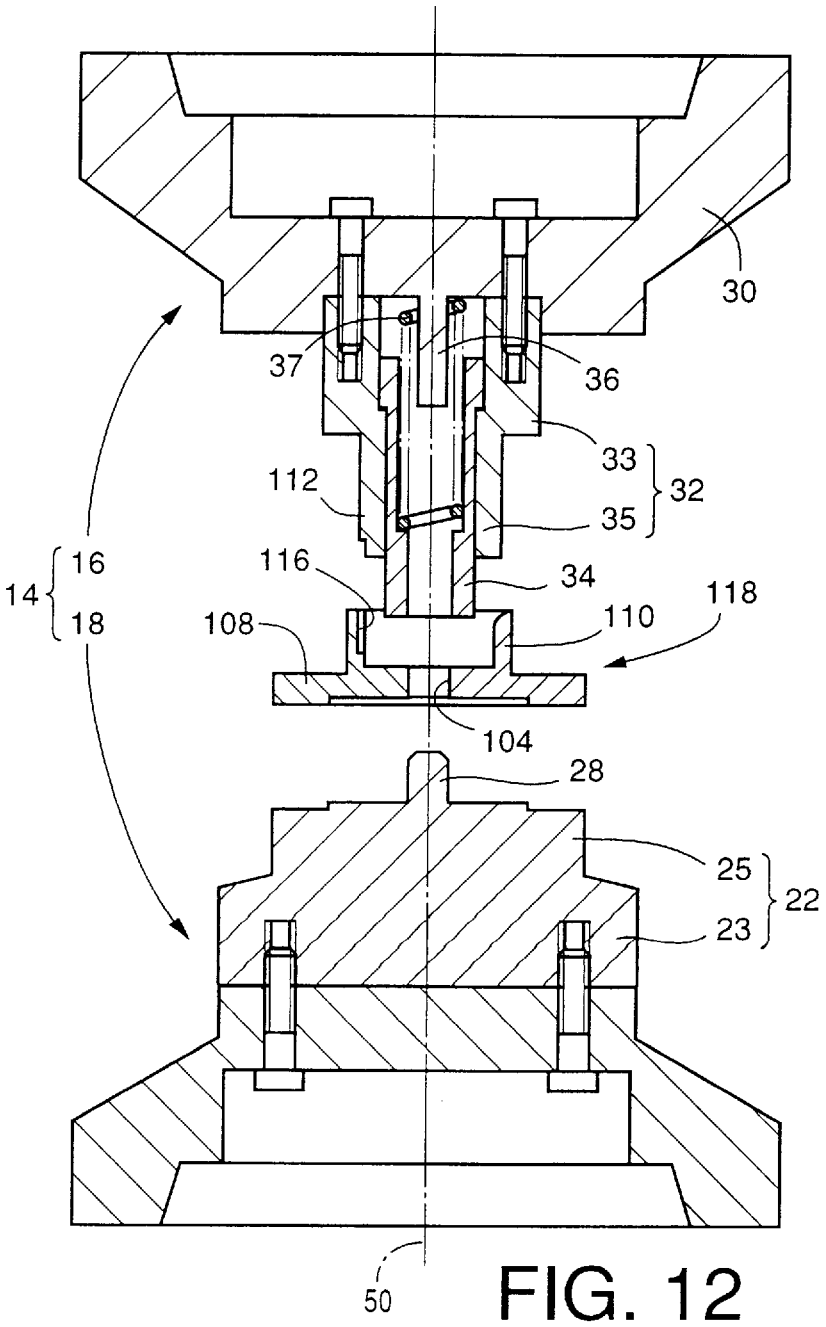
FIG. 12 is a view illustrating another step of the second invention process in which a formed metal body is ejected from the die device of FIG. 8.

FIG. 12 shows an intermediate formed body 118 including the base portion 108 which is formed from the original base portion 29 of the metal blank 114, and the cylindrical portion 110 which is formed on the outer surface of the base portion 110 such that the cylindrical portion 110 is integral with the base portion 108 and which has the key groove 116 formed in the inner surface thereof. Subsequently, the upper die 16 is retracted away from the lower die 18, and the center ejector pin 34 is advanced downward out of the inner hole of the upper pad 32 by the biasing action of the spring 37. Consequently the intermediate product 118 is ejected from the upper die 16 of the die device 14.

Figure 13:
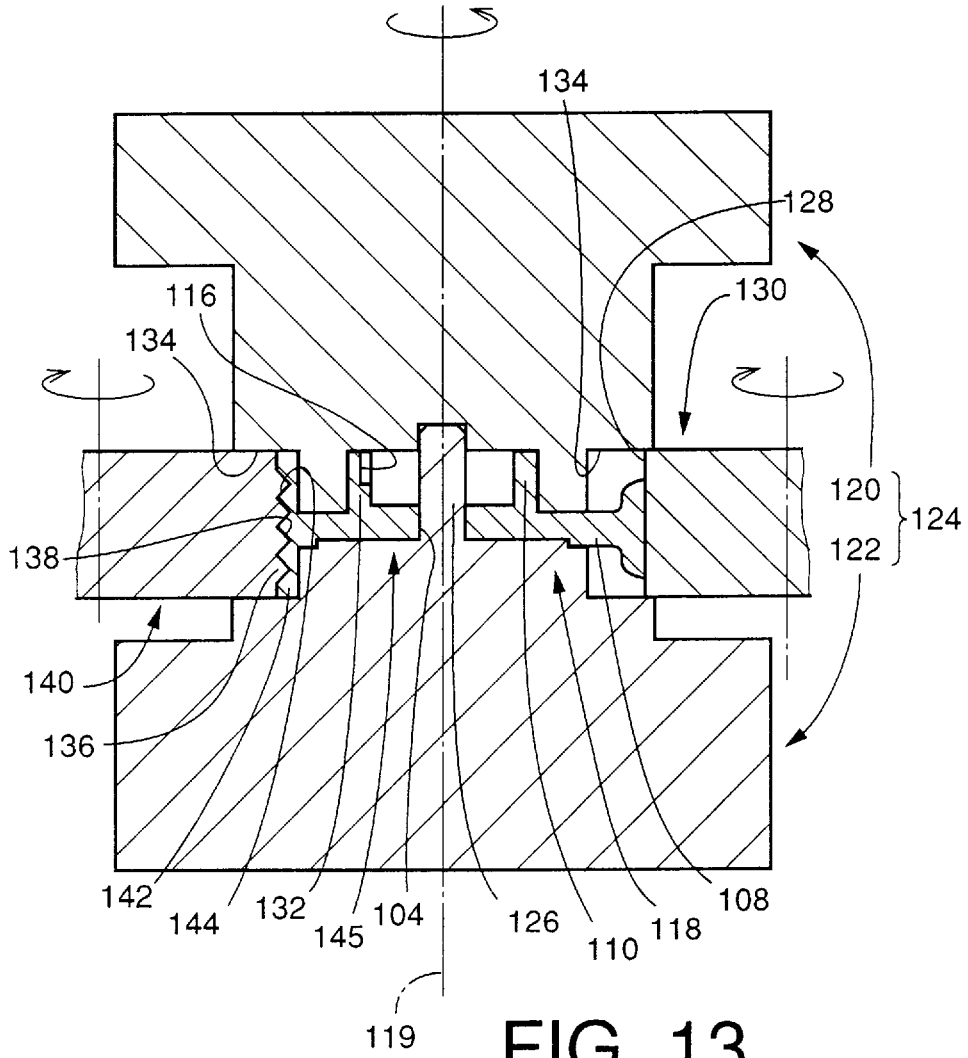
FIG. 13 is a view illustrating another step of the second invention process in which the formed metal body is worked into an aimed metal product by using a different die device, the right-hand half showing the step in which an outer peripheral portion of the formed body is deformed into a wheel portion, the left-hand half showing the step in which a plurality of grooves are formed in the wheel portion.

Then, as shown in FIG. 13, the intermediate product 118 is sandwiched between an upper die 120 and a lower die 122 of a conventional wheel-forming die device 124 which are movable toward and away from each other and are rotatable with each other about an axis line 119. The intermediate product 118 is set on the lower die 122 such that a center projection 126 projecting from the lower die 122 extends through a center through-hole 104 of the product 118. Thus, the product 118 is coaxially sandwiched by the two dies 120, 122. In this state, the product 118 and the two dies 120, 122 are rotated with one another about the axis line 119.

The right-hand half of FIG. 13 shows a wheel-forming roller 130 which has an cylindrical outer surface 128 vertically extending and having a constant diameter and which is rotatable about a vertical axis line and is movable toward, and away from, the wheel-forming die device 124. The roller 130 is moved toward the die device 124 and, when the two dies 120, 122 are closed, the roller 130 is forced into a wheel-forming space 134 defined by and between the closed dies 120, 122. Thus, the cylindrical outer surface 128 of the roller 130 is pressed against the outer surface of the base portion 108 of the intermediate product 118 which is sandwiched between the two dies 120, 122 and is rotated with the two dies 120, 122, and an outer peripheral portion of the base portion 108 is deformed, widened, and forced into the wheel-forming space 134. Consequently the intermediate product 118 has an annular wheel portion 142 as shown in the left-hand half of FIG. 13.

The left-hand half of FIG. 13 shows a groove forming roller 140 which is different from the wheel forming roller 130 in that the groove forming roller 140 has a plurality of annular projections 136 on an outer surface 138 thereof. Each annular projection 136 has a triangular cross section. The groove forming roller 140 is moved toward the wheel-forming die device 124 so as to enter the wheel-forming space 134. Thus, the outer surface 138 of the roller 140 having the annular projections 136 is pressed against the outer surface of the wheel portion 142 of the intermediate product 118, and cooperates with the upper and lower dies 120, 122 to sandwich the wheel portion 142. Consequently a plurality of annular grooves 144 corresponding to the annular projections 136, respectively, are formed in the outer surface of the wheel portion 142. A flexible belt or the like is wound around the grooves 144.

Thus, a pulley 145 is produced which includes a boss portion 132 consisting of the cylindrical portion 110 and having the key groove 116 in its inner surface, and a wheel portion 142 surrounding the boss portion 132 and having the grooves 144 in its outer surface.

In the above-described forming process, the pulley 145 including the boss portion 132 is very easily produced, without requiring any forging or cutting operation which needs a high cost and a long time. In addition, when the pulley 145 is produced, the key groove 116 is simultaneously formed in the inner surface of the boss portion 132. Thus, the pulley 145 can be produced with high efficiency and productivity.

Next there will be described a process for producing a pulley including a base portion and two boss portions on both sides of the base portion.

Figure 14:
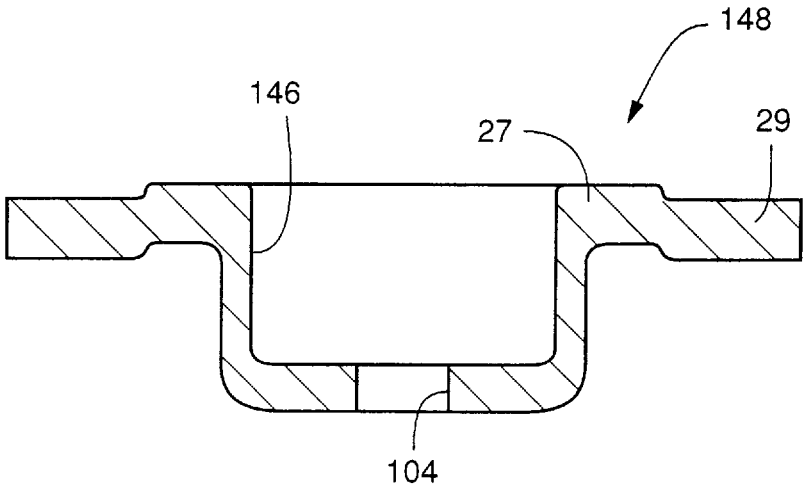
FIG. 14 is a cross section of a different metal blank which may be formed into a formed body by the forming apparatus of FIG. 8 employing another modified die device.

First, a metal blank 148 as shown in FIG. 14 is prepared in advance. The metal blank 148 has a generally disklike shape including an original base portion 29 which is to be formed into a base portion of an aimed pulley including a boss portion, a central recess 146 which opens on one of opposite sides of the base portion 29, and a cylindrical projection 27 which surrounds the opening of the central recess 146. The projection 27 is provided on an outer surface of the base portion 29 by subjecting the base portion 29 to, e.g. press bending. Thus, the metal blank 148 has a stepped cylindrical shape.

Figure 15:
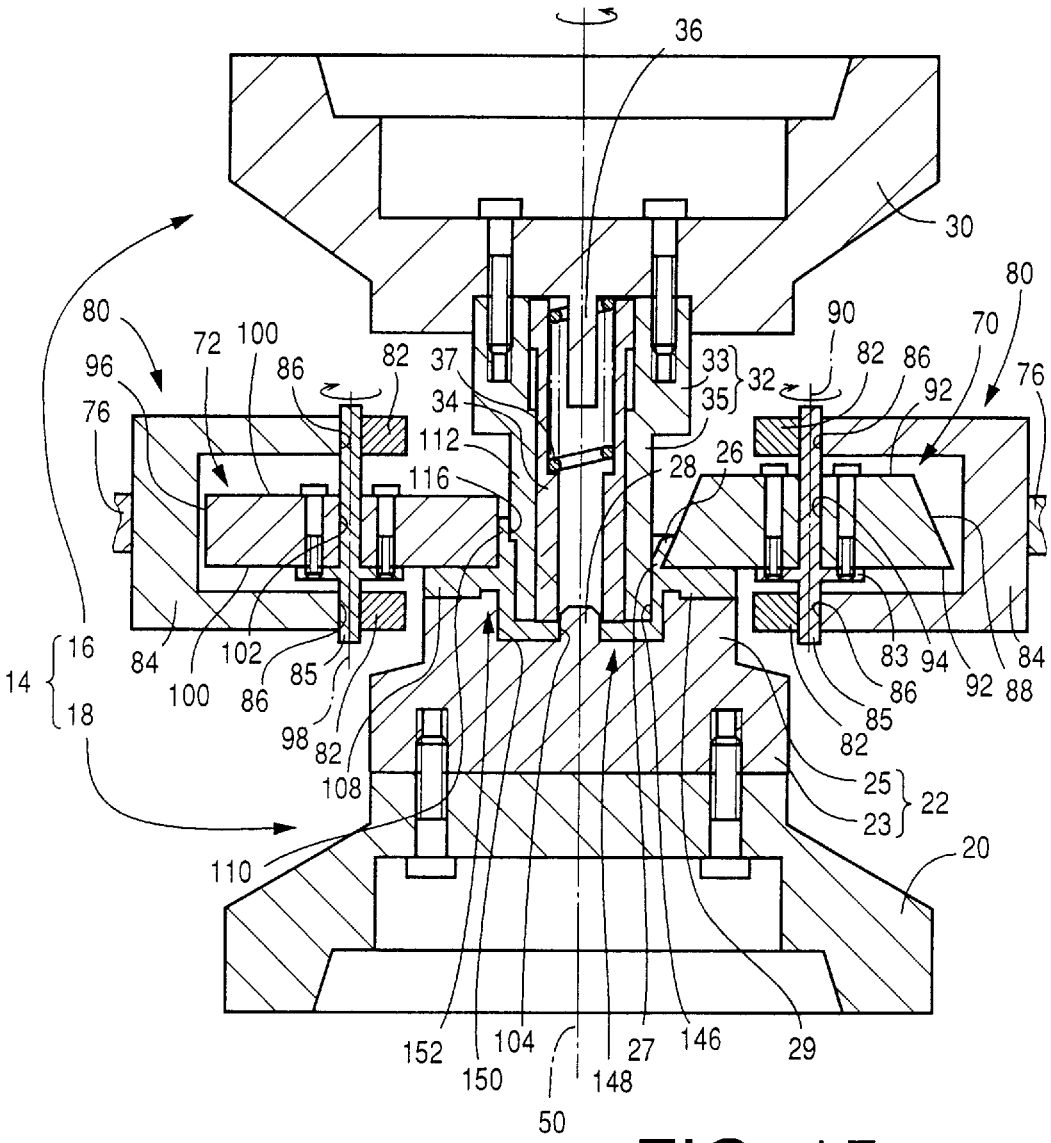
FIG. 15 is a view corresponding to FIG. 11, illustrating one step of a modified second invention process in which the metal blank of FIG. 14 is formed into a formed body.

As shown in FIG. 15, the metal blank 148 is concentrically sandwiched between the lower die 18 and the upper die 16 of the die device 14, and is rotated with the two dies 16, 18 about the first axis line 50. Subsequently, as shown in the right-hand half of FIG. 15, the tapered roller 70 is moved or transferred toward the die device 14, so that the tapered outer surface 88 of the roller 70 is pressed against the outer surface of the cylindrical projection 27 of the metal blank 148 which is being rotated with the dies 16, 18 about the axis line 50. Thus, the projection 27 is peeled from the base portion 29 of the metal blank 148, and the peeled portion 26 is deformed into a tapered portion having a tapered outer surface corresponding to the tapered outer surface 88 of the roller 70. Subsequently, as shown in the left-hand half of FIG. 15, the tapered roller 70 is replaced by the straight roller 72, and the straight roller 72 is moved or transferred toward the die device 14 so that the peeled portion 26 is bent at its lower end portion by the lower end portion of the straight roller 72 and the entirety of the peeled portion 26 is deformed into the cylindrical portion 110 by the entirety of the roller 72. In this process, the axial projection 112 provided integrally with the small-diameter portion 35 of the upper pad 32 operates for forming the key groove 116 in the inner surface of the cylindrical portion 110 formed from the peeled portion 26. In this case, the lower die 18 has a receiving hole 150 for receiving the recess 146 of the metal blank 148.

Thus, an intermediate formed body 151 is obtained which includes a base portion 108 which is formed from the original base portion 29 of the metal blank 148, and a cylindrical portion 110 which is formed on the outer surface of the base portion 108 such that the cylindrical portion 110 surrounds the central recess 146 and which has a key groove 116 formed in the inner surface thereof. Then, the upper die 16 is retracted away from the lower die 18, and the center ejector pin 34 is advanced downward out of the inner hole of the upper pad 32 by the biasing action of the spring 37. Consequently the intermediate product 152 is ejected from the upper die 16 of the die device 14.

Figure 16:
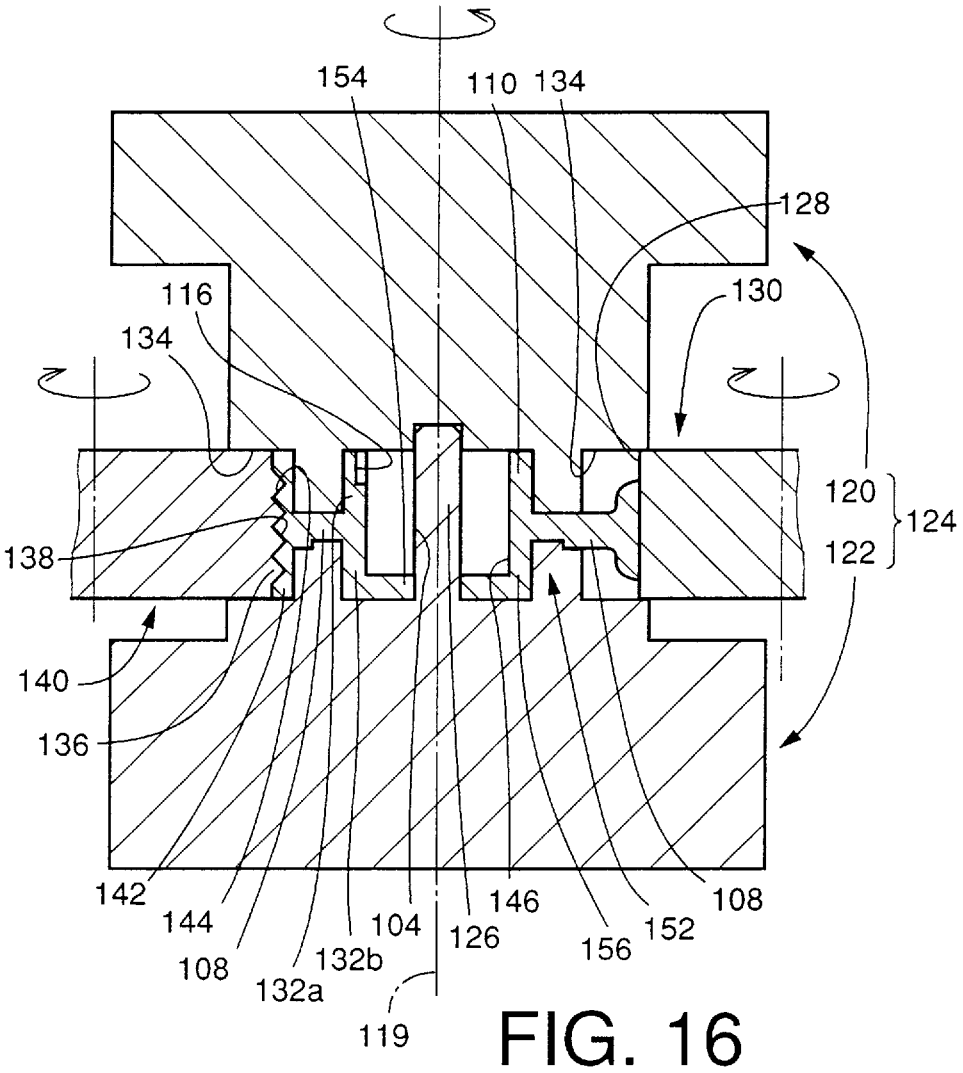
FIG. 16 is a view corresponding to FIG. 13, illustrating another step of the modified second invention process in which the formed body is worked into an aimed metal product by using a different die device.

Then, as shown in FIG. 16, the intermediate product 152 is sandwiched between the upper and lower dies 120, 122 of the wheel-forming die device 124, and the wheel-forming roller 130 and the the groove forming roller 140 are applied to the product 152 so as to form an outer peripheral portion of the base portion 108 of the product 152 into an annular wheel portion 142 having a plurality of annular grooves 144 in the outer surface thereof. Then, the intermediate product 152 is ejected from the die device 124, and a bottom portion 154 is removed from the central recess 146 by, e.g., or punching or cutting.

Thus, a pulley is produced which includes the base portion 108, a first boss portion 132*a* which is provided integrally with the base portion 108 on one side of the same 108, consists of the cylindrical portion 110, and has the key groove 116 in its inner surface, and a second boss portion 132*b* which is provided integrally with the base portion 108 on the other side of the same 108 and consists of a side wall 156 of the central recess 146. The pulley additionally includes the wheel portion 142 which is formed from the outer peripheral portion of the original base portion 29, has the annular grooves 144 in the outer surface thereof, and surrounds the two boss portions 132*a*, 132*b*.

In the above-described forming process, the pulley having the two boss portions 132*a*, 132*b* on both sides of the base portion 108 can be produced with high efficiency and productivity. In addition, when the pulley is produced, the key groove 116 is simultaneously formed in the inner surface of the first boss portion 132*a*.

Figure 17:
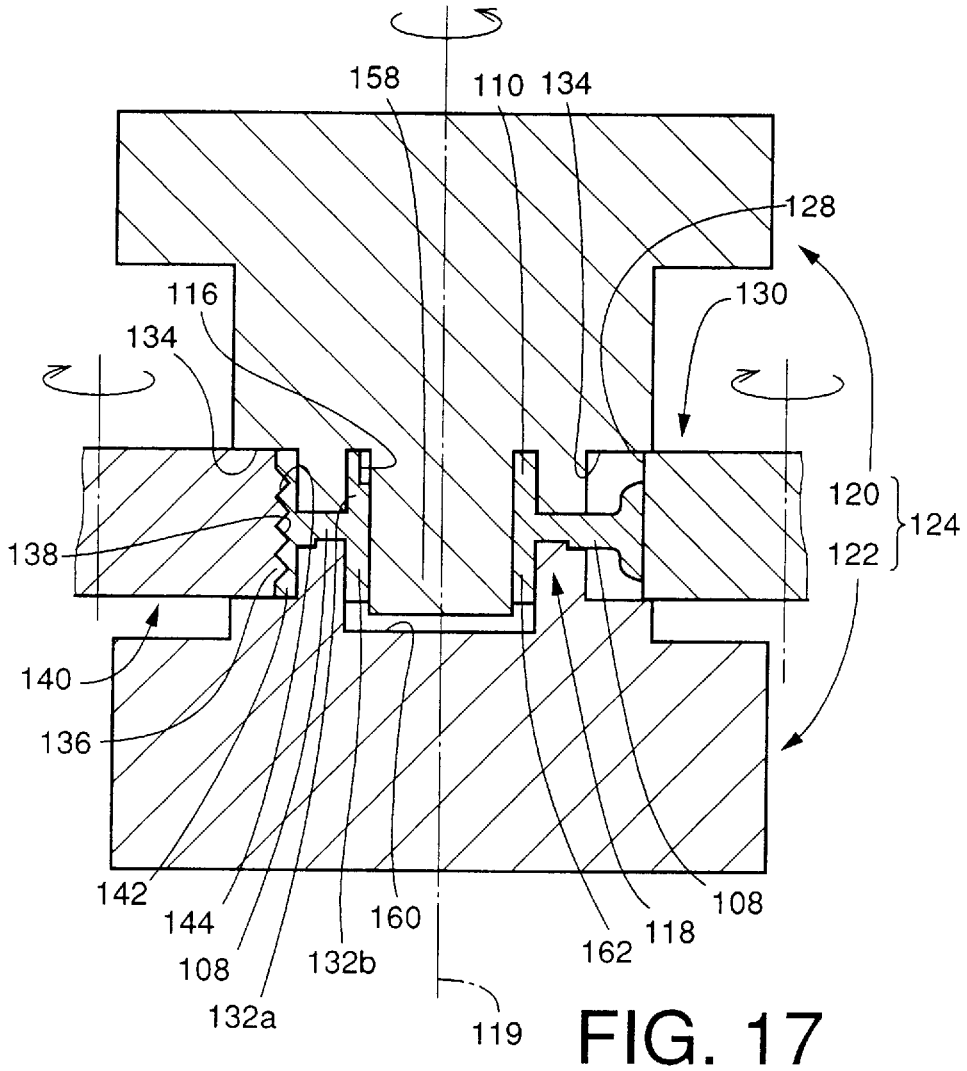
FIG. 17 is a view corresponding to FIG. 13, illustrating a modified step of the modified second invention process in which the formed body is worked into an aimed metal product by using a different die device.

However, a pulley having two boss portions 132*a*, 132*b* on both sides of a base portion 108 may be produced by the following manner in place of the above-described manner:

First, a metal blank 114 as shown in FIG. 9 is prepared in advance, and the metal blank 114 is formed into an intermediate product 118 in the same manner as described above. The product 118 includes cylindrical portion 110 which has a key groove 116 and is formed on an outer surface of a base portion 108 such that the cylindrical portion 110 is integral with the base portion 108. Then, the product 118 is sandwiched between an upper die 120 and a lower die 122 of a wheel-forming die device 124, as shown in FIG. 17. The upper die 120 has a central, cylindrical burring punch 158 whose outer diameter is slightly smaller than the inner diameter of the cylindrical portion 110 of the product 118. The lower die 122 includes a burring-punch receiving hole 160 for receiving the burring punch 158. Then, the burring punch 158 is applied to a central portion 162 of the base portion 108 so that the central portion 162 is deformed into a flange-like boss portion 132*b* which is oriented downward. Thus, the pulley is obtained which has the first boss portion 132*a* on one side of the base portion 108 and the second boss portion 132*b* on the other side of the same 108.

In this forming process, the aimed pulley can be produced more easily and more quickly by using the wheel-forming die device 124, without needing any punching or cutting operation.

Figure 18:
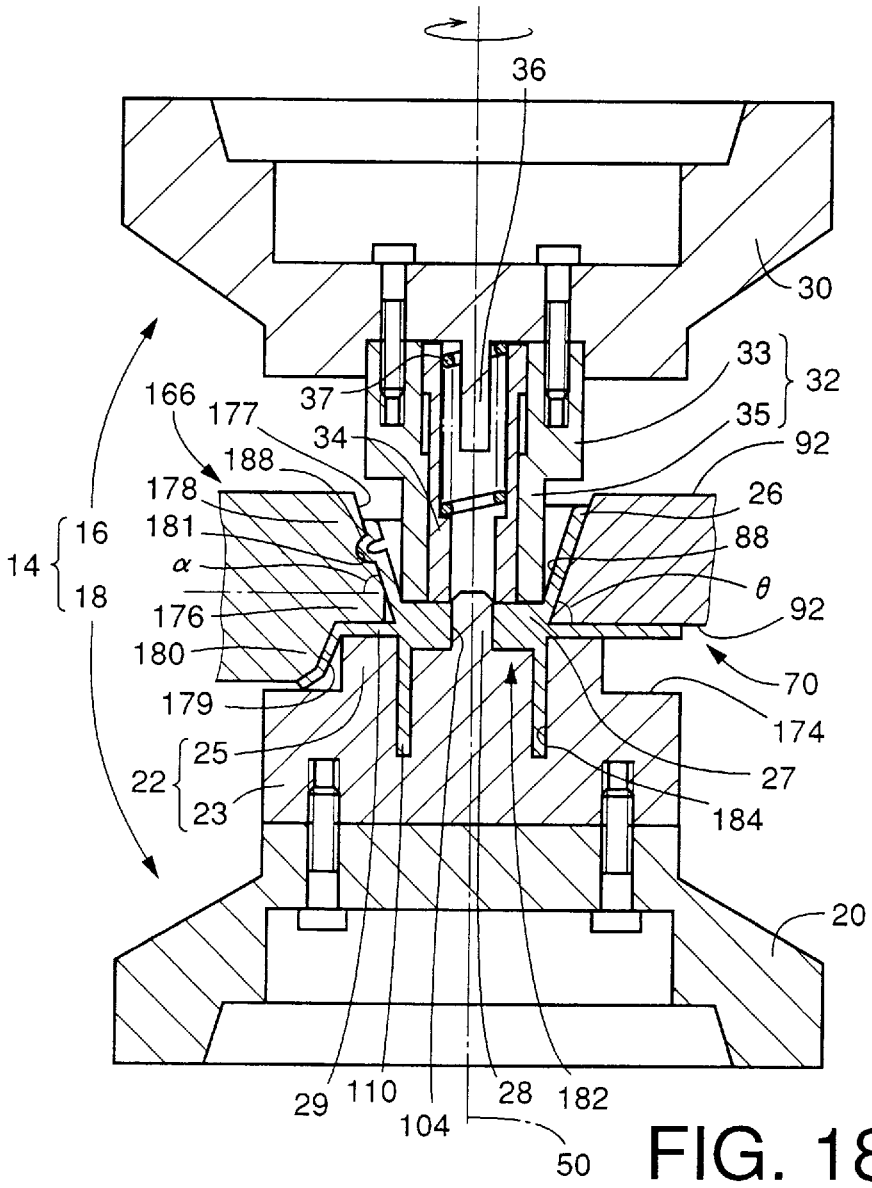
FIG. 18 is a cross section of yet another forming apparatus as a third embodiment of the present invention, the right-hand half showing one step of a third invention process in which a tapered roller peels a portion of a metal blank, the left-hand half showing another step of the third invention process in which a ridge-forming roller forms an annular ridge in an outer surface of the peeled portion of the metal blank.
Figure 19:
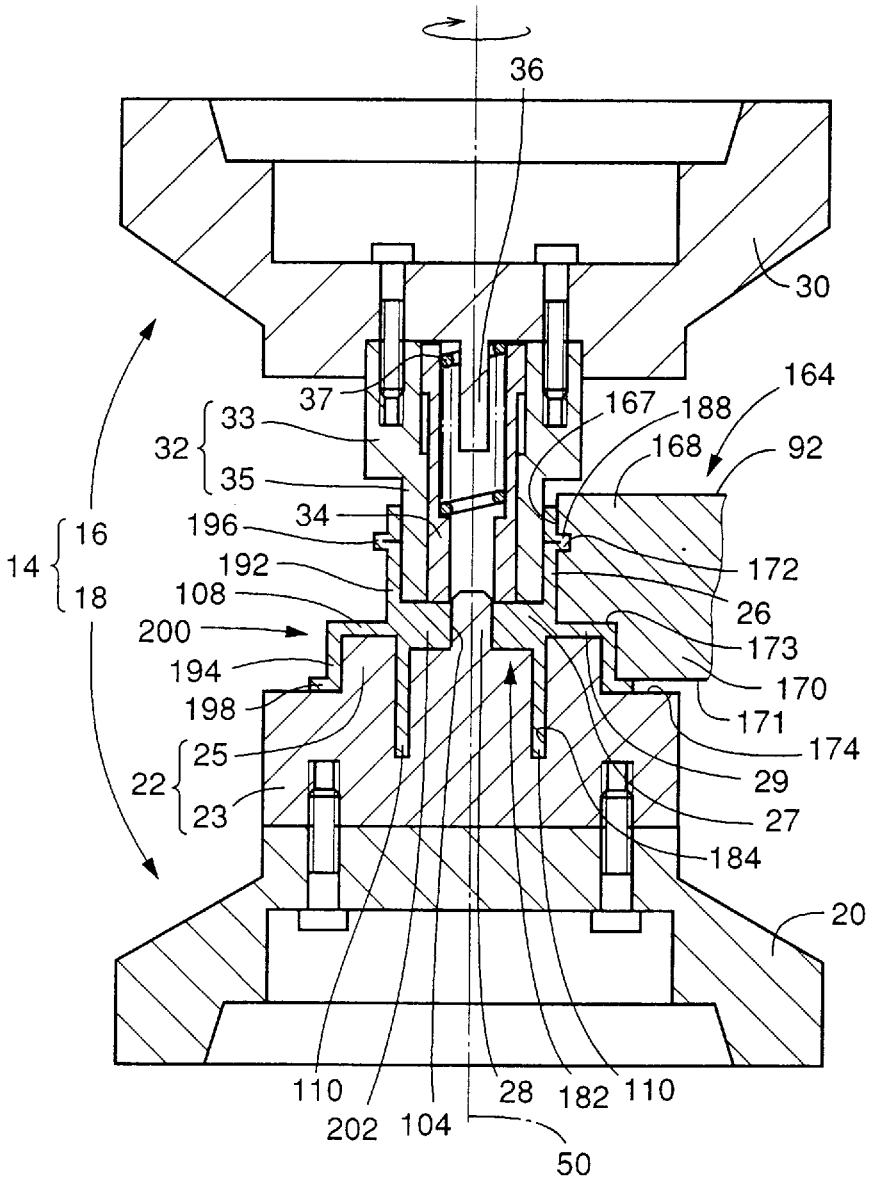
FIG. 19 is a view illustrating additional steps of the third invention process, the right-hand half showing the step in which the peeled portion is deformed into a cylindrical portion by a straight roller, the left-hand half showing a formed body before being ejected from a die device.

Referring next to FIGS. 18 and 19, there will described a third embodiment of the present invention. The third embodiment relates to a forming apparatus for forming a metal blank into a cylindrical part including one or more flange portions. The cylindrical part is used as a part of an automotive vehicle. The third forming apparatus is different from the first forming apparatus 10 only in that the third apparatus employs a straight roller 164 different from the straight roller 72 of the first apparatus 10, and additionally employs a ridge-forming roller 166. The two rollers 164, 166 are both rolling rollers. The die device of the third apparatus is shown in enlargement in FIGS. 18 and 19. The same reference numerals as used in the first apparatus shown in FIGS. 1–7 are used to designate the corresponding elements or parts of the third apparatus, and the description thereof is omitted from the following description.

The third forming apparatus includes the same die device 14 as that of the first forming apparatus 10 and the tree rolling rollers, that is, the same tapered roller 70 as that of the first apparatus 10, and the straight roller 164 and the ridge-forming roller 166.

More specifically described, the tapered roller 70 has a tapered outer surface 88 whose diameter decreases in a direction from the side of the lower die 18 toward the upper die 16. The tapered roller 70 has a truncated-conical shape having the tapered outer surface 88 and an upper and a lower circular surface 92, 92 each of which extends perpendicular to a central axis line of the roller 70. The roller 70 has a taper angle, $\theta$, of 70° ($\theta$=70°) which is defined by the lower surface 93 and the tapered outer surface 88.

The straight roller 164 includes an upper large-diameter portion 168 having a large-diameter cylindrical surface 167, and a lower small-diameter portion 170 having a small-diameter cylindrical surface 173. Thus, the roller 164 has a stepped cylindrical shape. The large-diameter portion 168 has a flange-forming portion in the form of an annular groove 172 in an axially intermediate portion thereof. The annular groove 172 has a rectangular cross section having predetermined width and depth, and continuously extends in a circumferential direction of the large-diameter portion 168 or the roller 164. The axial length of the small-diameter portion 170 is so predetermined that when the roller 164 is pressed against the die device 14 there is provided a predetermined space between a lower surface 171 of the portion 170 and a shoulder surface 174 of the large-diameter portion 23 of the lower pad 22 of the lower die 18.

The ridge-forming roller 166 includes an axially intermediate cylindrical portion 176 having a cylindrical outer surface whose diameter does not change in an axial direction thereof. The roller 166 additionally includes an upper tapered portion 178 having a tapered outer surface 177 whose diameter decreases in an upward direction from the side of the lower die 18 toward the side of the upper die 16. The roller 166 further includes a lower tapered portion 180 having a tapered outer surface 179 whose diameter decreases in a downward direction from the side of the upper die 18 toward the side of the lower die 16.

The upper tapered portion 178 has a taper angle, $\alpha$, of 80° which is defined by the tapered outer surface 177 and a plane which passes through the lower end of the tapered portion 178 and extends perpendicular to a central axis line of the roller 166. The taper angle of the lower tapered portion 180 changes at an axially intermediate position thereof, such that the taper angle of the lower portion of the lower tapered portion 180 is smaller than that of the upper portion of the same 180. Thus, the lower tapered portion 180 has a stepped tapered outer surface 179. The taper angle $\alpha$ may take any angle between the taper angle $\theta$ and 90°.

The ridge-forming roller 166 has an annular groove 181 at an axially intermediate position of the upper tapered portion 178. The annular groove 181 has a curved bottom surface and continuously extends in a circumferential direction of the roller 166. The annular groove 181 has a width greater than that of the annular groove 172 of the straight roller 164, and takes the same height as that of the annular groove 172 of the roller 164 when the roller 166 is set on the forming apparatus.

Each of the three rolling rollers, i.e., tapered roller 70, straight roller 164, and ridge-forming roller 166 is moved or transferred toward, and away from, the die device 14 in the same manner as that in which each of the rolling rollers 70, 72 is moved toward, and away from, the die device 14 in the first embodiment.

In the third forming apparatus including the three rolling rollers 70, 164, 166, as shown in the right-hand half of FIG. 18, first, the tapered roller 70 is pressed against a cylindrical projection 27 of an original disklike base portion 29 of a metal blank 182 which is sandwiched between the upper and lower dies 16, 18 of the die device 14 and is rotated with the two dies 16, 18. Thus, the projection 27 is peeled from the remaining portion of the base portion 29 by the tapered roller 70, and the peeled portion 26 is deformed into a tapered portion having a tapered outer surface corresponding to the tapered outer surface 88 of the tapered roller 70. The metal blank 182 includes a cylindrical portion 110 which is formed on one of opposite outer surfaces of the base portion 29 by the first forming apparatus 10. The lower pad 22 of the lower die 18 has an annular recess 184 for receiving the cylindrical portion 110 of the metal blank 182.

Next, as shown in the left-hand half of FIG. 18, the tapered outer surface 177 of the upper tapered portion 178 of the ridge-forming roller 166 is pressed against an upper portion of the tapered outer surface of the peeled or tapered portion 26, so that the upper portion of the tapered portion 26 is deformed into a tapered portion having a tapered outer surface corresponding to the tapered outer surface 177 of the upper tapered portion 178 and having the taper angle $\alpha$ greater than the taper angle $\theta$. In addition, the upper portion of the tapered portion 26 is partly forced into the annular groove 181 of the upper tapered portion 178. Thus, the upper portion of the tapered portion 26 has an annular ridge 188 which has a cross section corresponding to that of the annular groove 181 and which continuously extends in a circumferential direction of the tapered portion 26. Simultaneously, an outer peripheral portion of the remaining portion of the disklike base portion 29 of the metal blank 182 is pressed downward by the stepped tapered outer surface 179 of the lower tapered portion 180 of the ridge-forming roller 166, so that the outer peripheral portion of the base portion 29 is deformed into an intermediate tapered portion having a stepped tapered outer surface corresponding to the stepped tapered outer surface 179.

Then, as shown in the right-hand half of FIG. 19, the upper portion of the upper tapered portion 26 having the annular ridge 188, and a lower portion of the tapered portion 26 having the tapered outer surface corresponding to the tapered outer surface 88 of the tapered roller 70 and having the taper angle $\theta$ different from the taper angle $\alpha$, are pressed by the cylindrical outer surface 167 of the large-diameter portion 168 of the straight roller 164, and subsequently the entirety of the tapered portion 26 is sandwiched between the cylindrical outer surface 167 of the large-diameter portion 168 of the straight roller 164 and the cylindrical outer surface of the small-diameter portion 35 of the upper pad 32 of the upper die 16. Thus, the tapered portion 26 is bent and deformed at the border between the upper and lower portions thereof having the different taper angles, and at the base end thereof, i.e., border between itself 26 and the remaining portion of the base portion 29. Consequently the entirety of the tapered portion 26 is deformed into a small-diameter cylindrical portion 192 having a small diameter. In addition, the annular ridge 188 of the tapered portion 26 is forced into the annular groove 172 provided in the cylindrical outer surface 167 of the large-diameter portion 168 of the straight roller 164. Thus, the annular ridge 188 is deformed into an annular flange 196 having a rectangular shape corresponding to that of the annular groove 172.

Simultaneously, the intermediate tapered portion of the metal blank 182 having the stepped tapered outer surface is pressed by the cylindrical outer surface 173 of the small-diameter portion 170 of the straight roller 164, and subsequently sandwiched between the cylindrical outer surface 173 and circular lower surface 171 of the small-diameter portion 170 of the roller 164 and the cylindrical outer surface of the small-diameter portion 25 of the lower pad 22 of the lower die 18 and the shoulder surface 174 of the large-diameter portion 23 of the lower pad 22. Thus, the intermediate tapered portion is bent and deformed at the base end thereof, i.e., border between itself and the base portion 29 and at the border between the upper and lower tapered portions thereof having different taper angles. Thus, the intermediate tapered portion is deformed into a large-diameter cylindrical portion 194 which has a larger diameter than that of the small-diameter cylindrical portion 192 and which has a flange portion 198 extending radially outwardly of the cylindrical portion 194.

Thus, as shown in the left-hand half of FIG. 19, the metal blank 182 including the original disklike base portion 29 is formed into a cylindrical part 200. The cylindrical part 200 includes a base portion 108 corresponding to the remaining portion of the original base portion 29, the small-diameter portion 192 corresponding to the peeled portion 26 of the cylindrical projection 27, and the large-diameter cylindrical portion 194 corresponding to the outer peripheral portion of the base portion 29. The base portion 108 and the small- and large-diameter portions 192, 194 are integral with each other. The small-diameter portion 192 is formed on one of the opposite outer surfaces of the base portion 108. The flange portion 196 is integrally formed with the axially intermediate portion of the small-diameter cylindrical portion 192 such that the flange portion 196 extends radially outwardly of the cylindrical portion 192. The flange portion 198 is integrally formed with one of the axially opposite end portions of the large-diameter cylindrical portion 194 such that the flange portion 198 extends radially outwardly of the cylindrical portion 194. After the cylindrical part 200 including the flange portions 196, 198 is ejected from the die device 14, a central portion 202 of the base portion 108 is removed by punching or cutting. Thus, an end product is obtained.

In the third forming apparatus, the small-diameter cylindrical portion 192 is integrally formed with the base portion 108 by the tapered roller 70 and the straight roller 164. Thus, the third apparatus enjoys the same advantages as those of the first or second apparatus. In addition, since the third apparatus employs the ridge-forming roller 166 and the straight roller 164 different from the straight roller 72, the flange portion 196 is simultaneously formed with the small-diameter cylindrical portion 192 when the cylindrical portion 192 is formed from the peeled portion 26.

Thus, the third forming apparatus can produce, with high efficiency and productivity, the cylindrical part 200 including the cylindrical portion 192 which is provided on the outer surface of the base portion 108 which has the flange portion 196.

While the present invention has been described in its preferred embodiments, the invention may otherwise be embodied.

For example, while in each of the illustrated embodiments the upper die 16 as the first die is moved relative to the lower die 18 as the second die by the advancing and retracting movements of the piston rod 68 of the first hydraulic cylinder 66 provided above the upper die 16, the two dies 16, 18 may be moved relative to each other by a different moving device than the hydraulic cylinder 66.

In addition, in the illustrated embodiments, the lower die 18 as the second die which is provided on the base member 12 is rotatable about the axis line 50 by the electric motor 46 via the support member 38, and the upper die 16 as the first die is coaxially rotatable with the lower die 18 about the axis line 50. The two dies 16, 18 are movable relative to each other. While the two dies 16, 18 sandwich the metal blank 24, 114, 148, 182, the motor 46 is driven or rotated so that the two dies 16, 18 are rotated with each other about the axis line 50. However, the two dies 16, 18 may be rotated with each other by a different rotating device than the motor 46.

The first and second dies are not limited to the upper and lower dies 16, 18 of the die device 14 employed in the illustrated embodiments. According to the principle of the present invention, a different pair of first and second dies may be employed so long as the first and second dies are rotatable about a common axis line, the first die has a cylindrical outer surface corresponding to a cylindrical inner surface of a cylindrical portion of an aimed formed metal body, at least one of the first and second dies is movable toward, and away from, the other of the first and second dies along the common axis line, and the first and second dies are rotatable with each other about the common axis line while sandwiching a metal blank to be formed into the formed metal body.

In each of the illustrated embodiments, the clamp 80 is fixed to the free end of the piston rod 76 of the second hydraulic cylinder 78 provided on the base member 12, and the tapered roller 70 or the straight roller 72, 164 which is set on the clamp 80 is moved relative to the die device 14 by the advancing and retracting movements of the piston rod 76 in a direction perpendicular to the axis line 50 of the die device 14. However, the roller 70, 72, 164 may be moved relative to the die device 14 by a different moving device than the hydraulic cylinder 78.

In each of the illustrated embodiments, the single moving device including the clamp 80, the second hydraulic cylinder 78, and the piston rod 76 is employed for moving the tapered roller 70 or the straight roller 72, 164, and the tapered roller 80 and the straight roller 72, 164 are selectively set on the single moving device. Thus, the original base portion 29 of the metal blank is peeled and deformed into the tapered portion 26 by the tapered roller 70, and subsequently the tapered portion 26 is deformed into the cylindrical portion 110 by the straight roller 72, 164. However, the forming apparatus may employ a single or plural first moving devices for moving the tapered roller 70, and a single or plural second moving devices for moving the straight roller 72, 164. In the latter case, the first and second moving devices may be operated independent of each other. Since the operator does not have to change the tapered roller 70 and the straight roller 72, 164 with each other, his or her working efficiency is much more improved.

The tapered roller 70 as the first roller and the straight roller 72, 164 as the second roller may have different outer surfaces than those 88, 96, 167, 173 shown in the illustrated embodiments. According to the principle of the present invention, the first and second rollers may have different outer surfaces, so long as the first roller has a tapered outer surface whose diameter decreases in a direction from one of axially opposite ends thereof on the side of the second die toward the other axial end thereof on the side of the first die and the second roller has a cylindrical outer surface whose diameter is constant in an axial direction thereof.

Therefore, the first and second rollers may be provided by a single peeling and rolling roller including a lower tapered portion having a tapered outer surface and an upper cylindrical portion having a cylindrical outer surface, or a single peeling and rolling roller including a lower cylindrical portion and an upper tapered portion. In this case, the single roller functions as both the first and second rollers. However, the forming apparatus additionally needs a moving device for moving the single roller in an axial direction of the die device 14.

Figure 20:
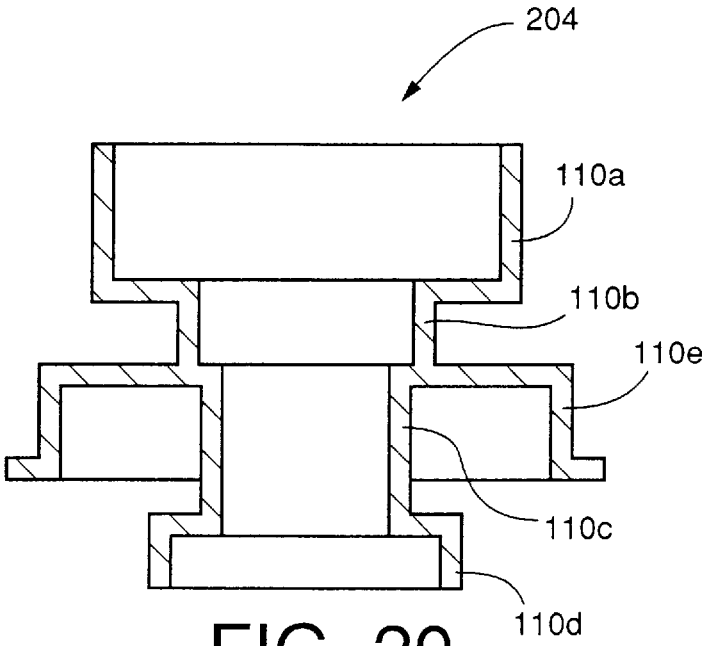
FIG. 20 is a cross section of a formed metal body provided by a fourth forming apparatus in accordance with the present invention.
Figure 21:
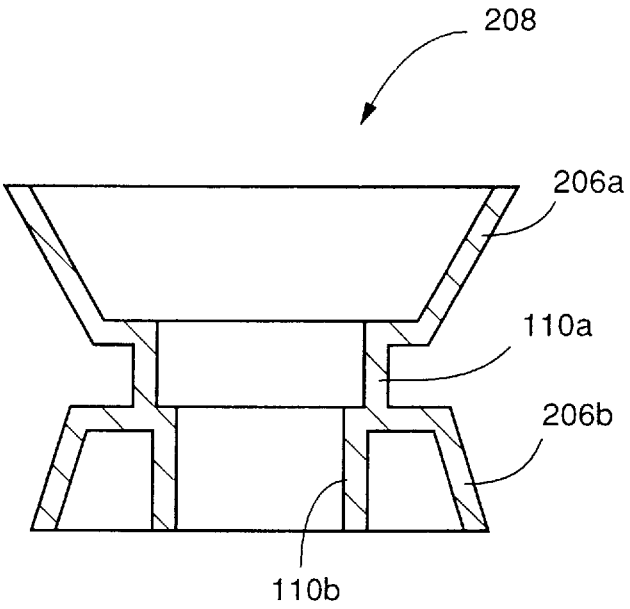
FIG. 21 is a cross section of a formed metal body provided by a fifth forming apparatus in accordance with the present invention.

Even in the case where the first and second rollers are provided in the form of separate members, the second roller may be provided in the form of a roller having a stepped cylindrical surface opposed to the first die, or a roller having one or more cylindrical outer surfaces and one or more tapered outer surfaces. In the case where a roller having a stepped cylindrical surface opposed to the first die is employed, a formed metal body 204 including a plurality of cylindrical portions 110*a*, 110*b*, 110*c*, 110*d*, 110*e*, having different diameters, as shown in FIG. 20, may be produced with ease and efficiency. In the case where a roller having one or more cylindrical outer surfaces and one or more tapered outer surfaces is employed, a formed metal body 208 including cylindrical portions 110*a*, 110*b* corresponding to cylindrical portions of the roller and tapered portions 206*a*, 206*b* corresponding to tapered portions of the roller, as shown in FIG. 21, may be produced with ease and efficiency.

In the illustrated embodiments, the tapered outer surface 88 of the tapered roller 70 has the taper angle of 70° which is defined by the outer surface 88 with respect to a plane perpendicular to the axis line 90 of the tapered roller 70 (i.e., lower end surface 92 of the roller 70). However, according to the principle of the present invention, the tapered outer surface 88 may have a different taper angle so long as the taper angle falls within the range of 60° to 80°. If the taper angle of the outer surface 88 exceeds the upper limit of 80°, the tapered roller 70 cannot peel the cylindrical projection 27 from the remaining portion of the original base portion 29 of the metal blank 24 and cannot deform or raise the peeled portion 26 along the tapered outer surface 88. Thus, the metal blank 24 cannot be formed into the formed body 106. On the other hand, if the taper angle is smaller than the lower limit of 60°, the tapered roller 70 exerts an excessively great upward component to the original base portion 29 of the metal blank 24, so that the metal blank 24 may break at the border between the cylindrical projection 27 and the remaining portion of the base portion 29.

In the second embodiment, the upper pad 32 of the upper die 16 of the die device 14 which is opposed to the straight roller 72 has, on the outer surface thereof, the axial projection 112 for forming the key groove 116 in the inner surface of the cylindrical portion 132 of the formed metal body 145 as the end product. However, the upper pad 32 of the upper die 16 may have a projection having a different shape than that of the axial projection 112, or a recess such as an axial groove. In the latter case, the cylindrical portion 132 of the formed metal body 145 has, in the inner surface thereof, a recess corresponding to the projection of the upper pad 32, or a projection corresponding to the recess of the upper pad 32.

In the third embodiment, the ridge-forming roller 166 includes the upper tapered portion 178, the intermediate cylindrical portion 176, and the lower tapered portion 180 in the order of description in the direction from the side of the upper die 16 toward the side of the lower die 18. However, the ridge-forming roller may have a different shape than that illustrated in the third embodiment, so long as the roller has a tapered outer surface which has a taper angle greater than that of the tapered outer surface 88 of the tapered roller 70, and has an annular groove which is formed in the tapered outer surface and continuously extends in the circumferential direction of the roller. Meanwhile, according to the present invention, the ridge-forming roller 166 may be omitted.

While the illustrated embodiments relate to the forming apparatuses and processes for forming the viscous-coupling housing, the pulley including the boss portion, and the cylindrical part including the flange portion, all for automotive vehicles. However, the present invention may be widely applied to other apparatuses and processes for forming other metal bodies each including a base portion and a cylindrical portion formed on an outer surface of the base portion such that the cylindrical portion is integral with the base portion.

It is to be understood that the present invention may be embodied with other changes, improvements, and modifications that may occur to those skilled in the art without departing from the scope and spirit of the invention defined in the appended claims.

What is claimed is:

1. An apparatus for forming a metal blank into a formed body including a disklike base portion and a cylindrical portion formed on an outer surface of the base portion such that the cylindrical portion is integral, and concentric, with the base portion, comprising:

a die device comprising a first die and a second die each of which is rotatable about a first axis line, said first die having a cylindrical outer surface corresponding to a cylindrical inner surface of the cylindrical portion of the formed body, at least one of said first and second dies being movable toward, and away from, the other of the first and second dies along said first axis line, said first and second dies being rotatable with each other about said first axis line while sandwiching the metal blank comprising an original disklike base portion having a diameter greater than a diameter of the first die, such that the original disklike base portion is concentric with the first and second dies with respect to said first axis line;

a first roller which is rotatable about a second axis line parallel to the first axis line and which is movable toward, and away from, said die device in a first direction perpendicular to said first axis line, said first roller having a tapered outer circumferential surface whose diameter decreases in a second direction from one of axially opposite ends thereof on a side of the second die toward the other end thereof on a side of the first die and which defines, at said one end thereof, a first taper angle of from 60° to 80° with respect to a plane perpendicular to the second axis line, said tapered outer circumferential surface of said first roller being pressed against the original disklike base portion of the metal blank being rotated with said first and second dies about said first axis line, so that said one end of the tapered outer circumferential surface peels a portion of the original disklike base portion and at least a portion of the tapered outer circumferential surface deforms the peeled portion into a tapered portion having a tapered outer circumferential surface corresponding to the tapered outer circumferential surface of the first roller; and a second roller which is rotatable about a third axis line parallel to the first axis line and which is movable toward, and away from, said die device in a third direction perpendicular to said first axis line, said second roller having a cylindrical outer surface extending in a fourth direction parallel to said third axis line, said cylindrical outer surface of said second roller being pressed against the tapered portion of the metal blank being rotated with said first and second dies about said first axis line, so that the second roller cooperates with said first die to sandwich the tapered portion and deforms the tapered portion into the cylindrical portion of the formed body which has a cylindrical outer surface corresponding to the cylindrical outer surface of the second roller.

2. An apparatus according to claim 1, wherein said first die has a projection on the cylindrical outer surface thereof, and wherein said second roller cooperates with the first die to sandwich the tapered portion of the metal blank and deforms the tapered portion into the cylindrical portion of the formed body which has the cylindrical inner surface including a recess corresponding to said projection.

3. An apparatus according to claim 1, wherein said first die has a recess in the cylindrical outer surface thereof, and wherein said second roller cooperates with the first die to sandwich the tapered portion of the metal blank and deforms the tapered portion into the cylindrical portion of the formed body which has the cylindrical inner surface including a projection corresponding to said recess.

4. An apparatus according to claim 1, further comprising a third roller which is rotatable about a fourth axis line parallel to the first axis line and which is movable toward, and away from, said die device in a fifth direction perpendicular to said first axis line, said third roller having a tapered outer circumferential surface whose diameter decreases in a sixth direction from one of axially opposite ends thereof on a side of the second die toward the other end thereof on a side of the first die and which defines a second taper angle greater than the first taper angle with respect to a plane perpendicular to the fourth axis line, said third roller having a first annular groove in the tapered outer circumferential surface thereof, said tapered outer circumferential surface of said third roller being pressed against the tapered portion of the metal blank being rotated with said first and second dies about said first axis line, so that the third roller modifies the tapered portion into a modified tapered portion which has a modified tapered outer surface including an annular ridge corresponding to said first annular groove.

5. An apparatus according to claim 4, wherein said second roller has a second annular groove in the outer cylindrical surface thereof, and cooperates with said first die to sandwich the modified tapered portion of the metal blank, force the annular ridge of the modified tapered portion into said second annular groove, and deform the modified tapered portion into the cylindrical portion of the formed body which has the cylindrical outer surface including an annular flange corresponding to said second annular groove.

6. An apparatus according to claim 1, wherein the first roller is moved toward the die device in the first direction, for peeling said portion of the original disklike base portion of the metal blank, so that said one end of the tapered outer circumferential surface of the first roller is positioned at a position closer to the first axis line than an outer peripheral edge of an end surface of the first die to sandwich the original disklike base portion.

7. A process of forming a metal blank into a formed body including a disklike base portion and a cylindrical portion formed on an outer surface of the base portion such that the cylindrical portion is integral, and concentric, with the base portion, the process comprising the steps of:

moving at least one of a first die and a second die of a die device, toward the other of the first and second dies, along a first axis line about which each of the first and second dies is rotatable, so that the first and second dies sandwich the metal blank comprising an original disklike base portion having a diameter greater than a diameter of the first die, such that the original disklike base portion is concentric with the first and second dies with respect to the first axis line, the first die having a cylindrical outer surface corresponding to a cylindrical inner surface of the cylindrical portion of the formed body, said one of the first and second dies being movable toward, and away from, the other of the first and second dies along the first axis line, rotating the first and second dies with each other about the first axis line while sandwiching the metal blank, moving a first roller toward the original disklike base portion of the metal blank being rotated with the first and second dies about the first axis line, the first roller being rotatable about a second axis line parallel to the first axis line, and being movable toward, and away from, the die device in a first direction perpendicular to the first axis line, the first roller having a tapered outer circumferential surface whose diameter decreases in a second direction from one of axially opposite ends thereof on a side of the second die toward the other end thereof on a side of the first die and which defines, at said one end thereof, a first taper angle of from 60° to 80° with respect to a plane perpendicular to the second axis line, pressing the tapered outer surface of the first roller against the original disklike portion of the metal blank, so that said one end of the tapered outer circumferential surface peels a portion of the original disklike base portion and at least a portion of the tapered outer circumferential surface deforms the peeled portion into a tapered portion having a tapered outer circumferential surface corresponding to the tapered outer circumferential surface of the first roller, moving a second roller toward the tapered portion of the metal blank being rotated with the first and second dies about the first axis line, the second roller being rotatable about a third axis line parallel to the first axis line, and being movable toward, and away from, the die device in a third direction perpendicular to the first axis line, the second roller having a cylindrical outer surface extending in a fourth direction parallel to the third axis line, and pressing the cylindrical outer surface of the second roller against the tapered portion of the metal blank, so that the second roller cooperates with the first die to sandwich the tapered portion and deforms the tapered portion into the cylindrical portion of the formed body which has a cylindrical outer surface corresponding to the cylindrical outer surface of the second roller.

8. A process according to claim 7, further comprising the step of preparing the metal blank comprising the original disklike base portion including an original cylindrical projection whose diameter is greater than the diameter of the first die and which projects from a remaining portion of the original disklike base portion, the original cylindrical projection having a predetermined axial length, wherein the step of peeling the portion of the original disklike portion comprises peeling the original cylindrical projection from the remaining portion of the original disklike base portion.

9. A process according to claim 7, wherein the step of pressing the second roller against the metal blank comprises pressing the second roller against the metal blank on the first die having a projection on the cylindrical outer surface thereof, so that the second roller cooperates with the first die to sandwich the tapered portion of the metal blank and deforms the tapered portion into the cylindrical portion of the formed body which has the cylindrical inner surface including a recess corresponding to the projection.

10. A process according to claim 7, wherein the step of pressing the second roller against the metal blank comprises pressing the second roller against the metal blank on the first die having a recess in the cylindrical outer surface thereof, so that the second roller cooperates with the first die to sandwich the tapered portion of the metal blank and deforms the tapered portion into the cylindrical portion of the formed body which has the cylindrical inner surface including a projection corresponding to the recess.

11. A process according to claim 7, wherein further comprising the steps of:

moving a third roller toward the tapered portion of the metal blank being rotated with the first and second dies about the first axis line, the third roller being rotatable about a fourth axis line parallel to the first axis line, and being is movable toward, and away from, the die device in a fifth direction perpendicular to the first axis line, the third roller having a tapered outer circumferential surface whose diameter decreases in a sixth direction from one of axially opposite ends thereof on a side of the second die toward the other end thereof on a side of the first die and which defines a second taper angle greater than the first taper angle with respect to a plane perpendicular to the fourth axis line, the third roller having a first annular groove in the tapered outer circumferential surface thereof, and pressing the tapered outer circumferential surface of the third roller against the tapered portion of the metal blank so that the third roller modifies the tapered portion into a modified tapered portion which has a modified tapered outer circumferential surface including an annular ridge corresponding to the first annular groove.

12. A process according to claim 11, wherein the step of pressing the second roller against the metal blank comprises pressing the second roller having a second annular groove in the outer cylindrical surface thereof, against the metal blank, so that the second die cooperates with the first die to sandwich the modified tapered portion of the metal blank, force the annular ridge of the modified tapered portion into the second annular groove, and deform the modified tapered portion into the cylindrical portion of the formed body which has the cylindrical outer surface including an annular flange corresponding to the second annular groove.

13. A process according to claim 7, wherein the step of moving the first roller comprises moving the first roller toward the die device in the first direction, for peeling said portion of the original disklike base portion of the metal blank, so that said one end of the tapered outer circumferential surface of the first roller is positioned at a position closer to the first axis line than an outer peripheral edge of an end surface of the second die which cooperates with an end surface of the first die to sandwich the original disklike base portion.

* * * * *